US009277318B2

(12) United States Patent
Sakai

(10) Patent No.: US 9,277,318 B2
(45) Date of Patent: Mar. 1, 2016

(54) SIGNAL PROCESSING APPARATUS, SIGNAL PROCESSING METHOD, AND PROGRAM

(75) Inventor: Juri Sakai, Tokyo (JP)

(73) Assignee: Sony Corporation, Tokyo (JP)

( * ) Notice: Subject to any disclaimer, the term of this patent is extended or adjusted under 35 U.S.C. 154(b) by 519 days.

(21) Appl. No.: 13/427,272

(22) Filed: Mar. 22, 2012

(65) Prior Publication Data

US 2012/0250900 A1 Oct. 4, 2012

(30) Foreign Application Priority Data

Mar. 31, 2011 (JP) ..... 2011-077445

(51) Int. Cl.
*H04R 3/00* (2006.01)
*H04R 3/04* (2006.01)
*H04R 1/10* (2006.01)

(52) U.S. Cl.
CPC ..... *H04R 3/04* (2013.01); *H04R 1/1083* (2013.01); *H04R 3/005* (2013.01); *H04R 2201/107* (2013.01); *H04R 2410/05* (2013.01); *H04R 2410/07* (2013.01); *H04R 2460/01* (2013.01); *H04R 2499/11* (2013.01); *H04R 2499/15* (2013.01)

(58) Field of Classification Search
CPC ..... H04R 29/00; H04R 29/004; H04R 3/005; H04R 25/30; H04R 25/305; H04R 25/554; H04R 25/558; H04R 1/08; H04R 1/1083; H04R 1/041; H04R 2225/55; H04R 2410/05; H04R 2430/03; H04R 2499/11; G10L 21/0208; G10L 2021/02087; G10L 2021/02165; G10L 25/51; A61B 5/048; A61B 5/12; A61B 5/7246; A61B 5/726
USPC ..... 381/122, 123, 119, 100, 97, 98, 92, 91, 381/94.9, 317, 56, 58, 26, 316, 318, 320, 381/321, 57, 60; 700/94
See application file for complete search history.

(56) References Cited

U.S. PATENT DOCUMENTS

| | | | | |
|---|---|---|---|---|
| 6,360,607 | B1 * | 3/2002 | Charette et al. | 73/587 |
| 7,046,812 | B1 * | 5/2006 | Kochanski et al. | 381/92 |
| 2007/0127736 | A1 * | 6/2007 | Christoph | 381/92 |
| 2007/0273585 | A1 * | 11/2007 | Sarroukh et al. | 342/379 |
| 2010/0158268 | A1 * | 6/2010 | Marton et al. | 381/92 |

FOREIGN PATENT DOCUMENTS

| | | |
|---|---|---|
| JP | 07-54998 | 6/1995 |

* cited by examiner

*Primary Examiner* — Leshui Zhang
(74) *Attorney, Agent, or Firm* — Paratus Law Group, PLLC

(57) ABSTRACT

A signal processing apparatus includes a filter that performs filtering of a correction filter characteristic including a reverse characteristic of an output characteristic of a microphone on a signal acquired by the microphone.

13 Claims, 18 Drawing Sheets

SIGNAL PROCESSING APPARATUS, SIGNAL PROCESSING METHOD, AND PROGRAM

BACKGROUND

The present disclosure relates to a signal processing apparatus, a signal processing method, and a program, and more particularly, to a signal processing apparatus and the like processing a signal acquired by a microphone.

Recently, through miniaturization of products and design which lays emphasis on design properties, the sizes of microphones themselves have been reduced, and sound waves reaching the vibration plate diffract at the narrow opening portion causing confusion in frequency characteristics and phase characteristics, and thus various problems occur. When one microphone is provided, deterioration of the sound collection function occurs.

When a plurality of microphones are provided, a sound signal process using volume differences and/or phase differences applied after sound collection may be also affected. For example, there are deterioration of channel separation of a channel number conversion process such as down mix and up mix, a decrease of precision of a beamforming technique represented by sound source localization and directional sound recording, and the like. As described above, the frequency characteristics and phase characteristics of the microphone are confused to cause various problems, but an effective solution has not been proposed.

In Japanese Examined Patent Application Publication No. 07-054998, a technique of correction by an IIR filter using a graphic equalizer as an example is proposed.

SUMMARY

The technique disclosed in Japanese Examined Patent Application Publication No. 07-054998 is to divide signals into several frequency bands to perform correction. For this reason, in the technique, it is difficult to perform strict correction on desired sound characteristics.

In reproduction environment, increase in the number of channels is in progress to multichannels such as 5.1 channels and 7.1 channels, and it is difficult to provide microphones corresponding to the number of channels on the recording side to a device. It is conceivable to perform recording using a plurality of channels using a functional microphone provided for another usage in the same device as a device provided with a recording microphone. In addition, it is conceivable to perform recording using a plurality of channels using a recording microphone provided in another device different from a device provided with a recording microphone or a functional microphone for another usage. The microphones are different in frequency characteristics and phase characteristics due to differences in installation position, shape and kind, and thus it is difficult to perform satisfactory recording using the plurality of channels.

It is desirable to effectively correct sound characteristics (frequency characteristics and phase characteristics) of a microphone.

According to an embodiment of the present disclosure, there is provided a signal processing apparatus including a filter that performs filtering of a correction filter characteristic including a reverse characteristic of an output characteristic of a microphone on a signal acquired by the microphone.

The present disclosure is a technique of correcting sound characteristics of a signal acquired by a microphone, that is, a frequency characteristic and a phase characteristic, to be a desired sound characteristic. In the present disclosure, a filter with a correction filter characteristic including a reverse characteristic of an output characteristic of the microphone may be provided. The sound characteristic of the signal acquired by the microphone is corrected by filtering using the filter.

As described above, in the present disclosure, the sound characteristic of the signal acquired by the microphone is corrected using the filter with the correction filter characteristic including the reverse characteristic of the output characteristic of the microphone. The correction filter characteristic includes the reverse characteristic of the output characteristic of the microphone, a frequency characteristic of the microphone is flattened, a process of making a phase characteristic to a linear phase is basically performed, and thus it is possible to effectively correct the sound characteristic of the microphone.

In the present disclosure, for example, the filter may be a filter having a constant group delay characteristic. As the filter with the constant group delay characteristic, for example, there is an FIR (Finite Impulse Response) filter. In this case, it is possible to correct the sound characteristic without causing phase characteristic distortion.

In the present disclosure, for example, the correction filter characteristic may be the reverse characteristic of the output characteristic of the microphone. In this case, the frequency characteristic of the microphone is flattened, the phase characteristic can be the linear phase, and thus it is possible to improve a sound collection function.

In the present disclosure, for example, the correction filter characteristic may be a characteristic obtained by combining the reverse characteristic of the output characteristic of the microphone and the reverse characteristic of the sound characteristic based on a structure surrounding the microphone. In this case, the frequency characteristic of the microphone is flattened including deterioration of the frequency characteristic based on the structure, and the correction is performed to make the phase characteristic to a linear phase. For this reason, it is possible to perform sound correction which is not easily affected by the structure.

In the present disclosure, for example, the correction filter characteristic may be a characteristic obtained by combining the reverse characteristic of the output characteristic of the microphone and a predetermined sound characteristic. In this case, it is possible to combine the sound characteristic of the microphone with a predetermined sound characteristic, for example, a sound characteristic of another microphone.

In the present disclosure, for example, a signal switching unit that selectively outputs the signal acquired by the microphone or the output signal of the filter may be further provided. In this case, switching of acoustic characteristics of the microphone between the output characteristics of the microphone themselves and where the frequency characteristics are flattened and the phase characteristics transformed into a linear phase is possible, and thus one microphone can take on two roles.

In the present disclosure, for example, the signal processing apparatus may further include a filter characteristic switching unit that changes the correction filter characteristic of the filter, and a plurality of characteristics may be provided as the correction filter characteristic of the filter. In this case, it is possible to switch the sound characteristic of the microphone to any one of the plurality of sound characteristics, and one microphone can take on a plurality of roles.

According to another embodiment of the present disclosure, there is provided a signal processing apparatus including a plurality of signal processing units that process signals acquired by a plurality of microphones, wherein at least one of the plurality of signal processing units has a filter that performs filtering of a correction filter characteristic including a reverse characteristic of an output characteristic of a microphone on a signal acquired by the corresponding microphone.

In the present disclosure, the plurality of signal processing units that respectively process the signals acquired by the plurality of microphones are provided. In the present disclosure, at least one of the plurality of signal processing units has a filter with a correction filter characteristic including the reverse characteristic of the output characteristic of the microphone on the signal acquired by the microphone. The sound characteristic of the signal acquired by the microphone is corrected by the filtering using the filter.

As described above, in the present disclosure, in at least one of the plurality of signal processing units, the sound characteristic of the signal acquired by the microphone is corrected using the filter with the correction filter characteristic including the reverse characteristic of the output characteristic of the microphone. For example, the correction filter characteristic is the reverse characteristic of the output characteristic of the microphone, and the correction is performed such that the frequency characteristic of the microphone is flattened and the phase characteristic is a linear phase. For example, the correction filter characteristic is a characteristic obtained by combining the reverse characteristic of the output characteristic of the microphone and a predetermined sound characteristic, and the sound characteristic of the microphone is corrected to be a predetermined sound characteristic, for example, a sound characteristic of the other microphone.

As described above, in the present disclosure, the correction filter characteristic includes the reverse characteristic of the output characteristic, a process of flattening the frequency characteristic of the microphone and making the phase characteristic to the linear phase is basically performed, and thus it is possible to effectively correct the sound characteristic of the microphone. For this reason, it is possible to perform satisfactory recording using a plurality of channels by combining the sound characteristics of the plurality of microphones.

In the present disclosure, for example, the filter may be a filter with a constant group delay characteristic. As the filter with the constant group delay characteristic, for example, there is an FIR (Finite Impulse Response) filter or the like. In this case, it is possible to correct the sound characteristics without causing phase characteristic distortion.

That is, it is possible to make the frequency characteristic and the phase characteristic of the microphone equal. For this reason, the process result in channel separation of a sound signal process using volume difference and/or phase difference applied after recording (after sound collection), for example, a channel number conversion process such as down mix and up mix becomes satisfactory.

In the present disclosure, the signal processing unit having the filter may further include a signal switching unit that selectively outputs the signal acquired by the microphone or the output signal of the filter. In this case, switching of acoustic characteristics of the microphone between the output characteristics of the microphone themselves and where the frequency characteristics are flattened and the phase characteristics transformed into a linear phase is possible, and thus the microphone can take on a plurality of roles.

According to still another embodiment of the present disclosure, there is provided a signal processing apparatus including a signal processing unit that receives an input signal acquired by a microphone and outputs a result of filtering of a correction filter characteristic including a reverse characteristic of an output characteristic of a microphone on the signal, wherein the signal processing unit has a communication unit that performs communication for the filtering between the signal processing unit and an external device connected to a network.

The present disclosure is a technique of correcting sound characteristics of a signal acquired by a microphone to be a desired sound characteristic. In the present disclosure, a signal processing unit that receives an input signal acquired by the microphone and outputs a result of filtering of a correction filter characteristic including a reverse characteristic of an output characteristic of a microphone on the signal may be provided.

In this case, the signal processing unit has a communication unit that performs communication for filtering between the signal processing unit and an external device connected to a network. For example, the communication unit transmits the signal acquired by the microphone to the external device, and receives a result of performing the filtering from the external device. For example, the communication unit receives a coefficient of the correction filter characteristic from the external device.

As described above, in the present disclosure, the signal processing unit performs the communication for the filtering between the signal processing unit and the external device connected to the network, and the result of performing the filtering of the correction filter characteristic including the reverse characteristic of the output characteristic of the microphone on the signal acquired by the microphone is obtained. For this reason, the signal processing unit is not provided with a filter or a storage unit of the correction filter coefficient, the frequency characteristic is flattened, and it is possible to output the filtering result corrected in the sound characteristic in which the phase characteristic is made to a linear phase or the same sound characteristic as that of the other microphone.

According to the present disclosure, it is possible to effectively correct sound characteristics (frequency characteristics and phase characteristics) of the microphone.

DETAILED DESCRIPTION OF EMBODIMENTS

Hereinafter, embodiments of the present disclosure will be described. The description is performed in the following order.

1. First Embodiment
2. Second Embodiment
3. Third Embodiment
4. Fourth Embodiment
5. Fifth Embodiment
6. Sixth Embodiment
7. Seventh Embodiment
8. Eighth Embodiment
9. Modified Example <1. First Embodiment>

[Example of Configuration of Signal Processing Apparatus]

Figure 1:
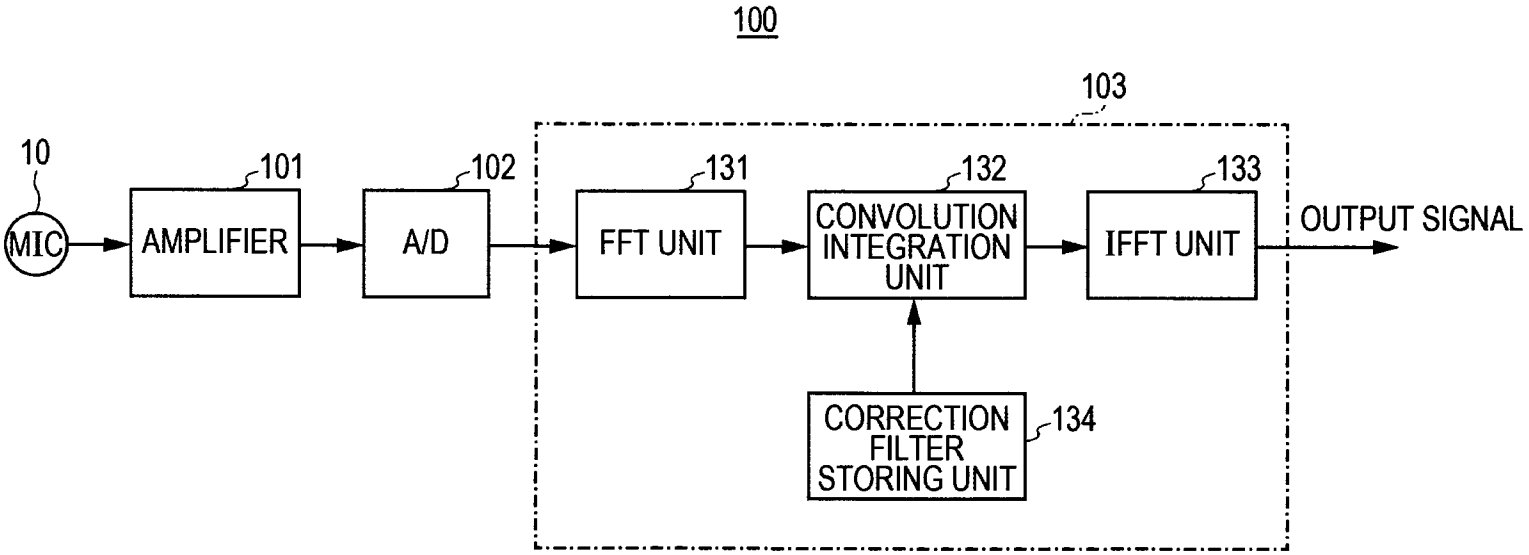
FIG. 1 is a block diagram illustrating an example of a configuration of a signal processing apparatus according to a first embodiment of the present disclosure.

FIG. 1 shows an example of a configuration of a signal processing apparatus 100 according to a first embodiment. The signal processing apparatus 100 includes an amplifier 101, an A/D converter 102, and a signal processing unit 103.

The amplifier 101 amplifies a signal acquired by a microphone 10. The A/D converter 102 converts an output signal of the amplifier 101 from an analog signal into a digital signal. The signal processing unit 103 corrects sound characteristics (frequency characteristic and phase characteristic) of the microphone 10 to desired sound characteristic. The signal processing unit 103 has a filter that performs filtering of a correction filter characteristic including a reverse characteristic of an output characteristic of the microphone on the output signal of the A/D converter 102, that is, the signal acquired by the microphone 10. In the embodiment, an FIR filter with a constant group delay characteristic is used as the filter.

The signal processing unit 103 includes an FFT unit (fast Fourier transform unit) 131, a convolution integration unit 132, an inverse FFT unit 133, and a correction filter storing unit 134. The FFT unit 131 converts the signal acquired by the microphone 10 from a signal on a time axis into a signal on a frequency axis. The convolution integration unit 132 constitutes an FIR filter. The convolution integration unit 132 convolves the correction filter (coefficient of correction filter) stored in the correction filter storing unit 134. The inverse FFT unit 133 converts the output signal of the convolution integration unit 132 from a signal on the frequency axis into a signal on the time axis.

Herein, characteristics of the correction filter stored in the correction filter storing unit 134 will be described. The correction filter characteristics are, for example, the following (1) to (3).

(1) The correction filter characteristics are a reverse characteristic $Hm^{-1}$ of an output characteristic of the microphone 10.

Figure 2A:
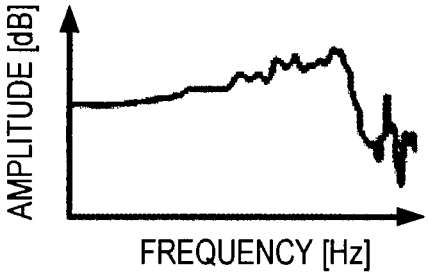
FIG. 2A and FIG. 2B are diagrams illustrating an example of an output characteristic of a microphone.
Figure 2B:
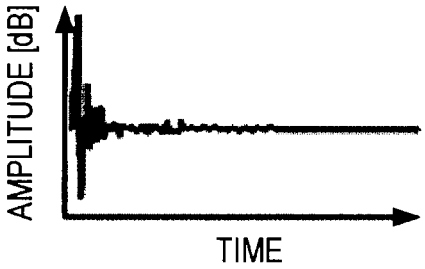
Figure 3A:
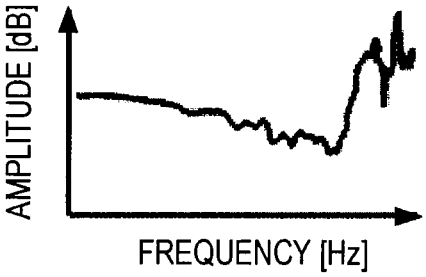
FIG. 3A and FIG. 3B are diagrams illustrating an example of a reverse characteristic of the microphone.
Figure 3B:
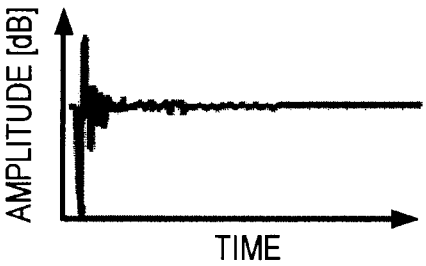

The correction filter characteristics are based on the reverse characteristic $Hm^{-1}$ of the output characteristic of the microphone 10 when the impulse signal is obtained by sound collection of the impulse signal by the microphone 10. FIG. 2A and FIG. 2B show an example of the output characteristic Hm of the microphone 10, FIG. 2A is a frequency characteristic, and FIG. 2B is an impulse response. FIG. 3A and FIG. 3B show an example of the reverse characteristic $Hm^{-1}$ of the microphone 10, FIG. 3A is a frequency characteristic, and FIG. 3B is an impulse response.

Figure 4:
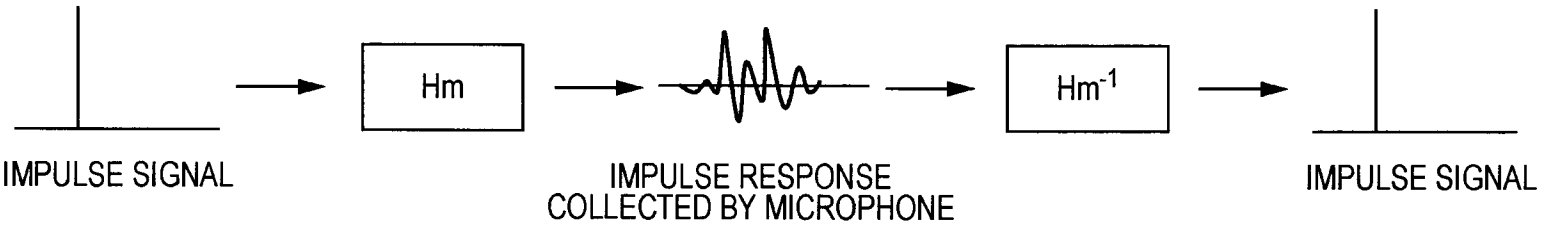
FIG. 4 is a diagram illustrating a relationship among an impulse signal, an impulse response obtained by sound collection of the microphone of the output characteristic and an impulse signal obtained by filtering the impulse response using a filter of the reverse characteristic.

FIG. 4 shows a relationship among the impulse signal, the impulse response obtained by sound collection of the output characteristic Hm by the microphone 10, and the impulse signal obtained by filtering the impulse response by the filter with the reverse characteristic $Hm^{-1}$. From the relationship, it can be known that filtering is performed with the correction filter characteristic of the reverse characteristic $Hm^{-1}$ of the microphone 10 on the signal reaching the microphone 10 of the output characteristic Hm, the frequency characteristic of the microphone 10 is thereby flattened, and it is possible to perform correction such that the phase characteristic is a linear phase.

Figure 5:
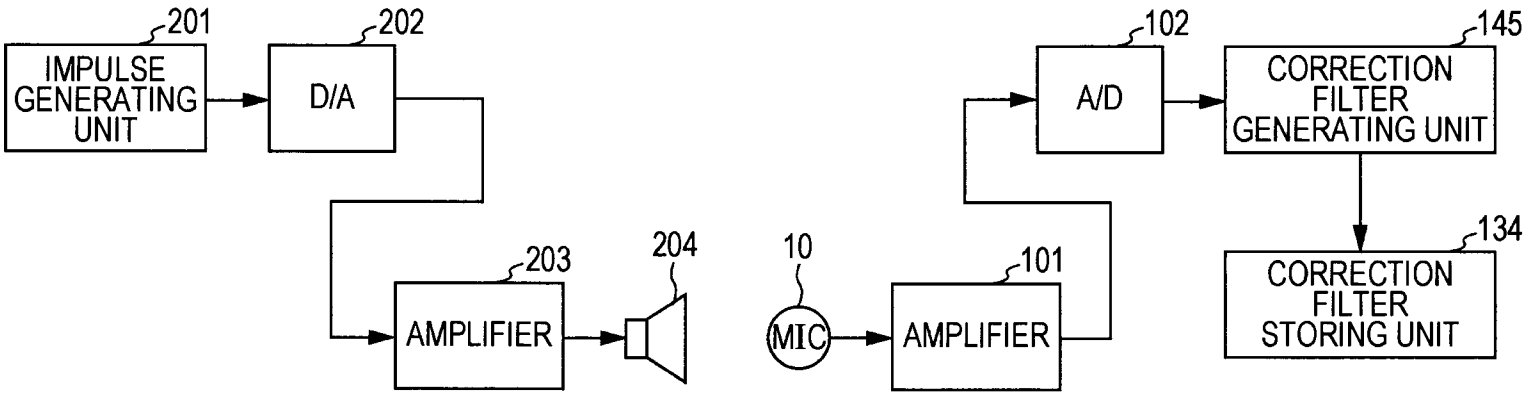
FIG. 5 is a diagram illustrating an example of a configuration of a signal system at the time of creating a correction filter (coefficient of correction filter).

FIG. 5 shows an example of a configuration of a signal system at the time of creating the correction filter (coefficient of correction filter). The impulse signal output from the impulse generating unit 201 is converted from a digital signal into an analog signal by the D/A conversion unit 202, is amplified by the amplifier 203, and is supplied to the speaker 204. Accordingly, the impulse signal is output from the speaker 204.

As described above, the impulse signal output from the speaker 204 is measured by the microphone 10. The impulse response acquired by the microphone 10 is amplified by the amplifier 101, is converted from an analog signal into a digital signal by the A/D converter 102, and is supplied to the correction filter generating unit 145. In the correction filter generating unit 145, the correction filter (coefficient of correction filter) is generated on the basis of the impulse response acquired by the microphone 10. The correction filter is stored in the correction filter storing unit 134.

(2) The correction filter characteristic is a characteristic obtained by combining the reverse characteristic $Hm^{-1}$ of the output characteristic Hm of the microphone 10 and the reverse characteristic $Hc^{-1}$ of the sound characteristic Hc based on the structure surrounding the microphone 10.

According to the structure surrounding the microphone 10, a part of a sound wave reaching a sound receiving face (vibration face) of the microphone may be diffracted or blocked. For example, there is a case where the microphone 10 is embedded in the device, the front face of a vibration plate is covered with an exterior, and a sound wave is received through a hole or a slit, or a case where no opening portion is provided. For example, there is a case where the vibration face of the microphone 10 embedded in the device is not directed to an assumed arrival direction of a sound source, or a case where a part or the whole of the microphone 10 is covered with a head case such as metal mesh or a filter for blocking a wind pressure.

Figure 6:
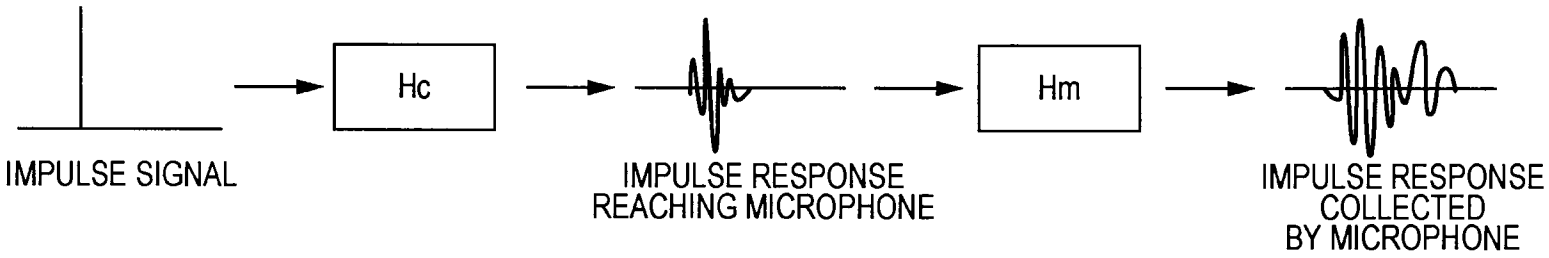
FIG. 6 is a diagram illustrating a relationship among an impulse signal, an impulse response changed by a sound characteristic based on a structure and reaching the microphone, and an impulse response obtained by sound collection of the microphone of the output characteristic.

In this case, by the structure surrounding the microphone 10, the impulse response itself reaching the microphone 10 is changed by the sound characteristic Hc based on the structure, as well as the output characteristic Hm of the microphone 10. FIG. 6 shows a relationship among the impulse signal, the impulse response changed by the sound characteristic Hc based on the structure and reaching the microphone 10, and the impulse response obtained by sound collection of the microphone 10 with the output characteristic Hm.

Figure 7:
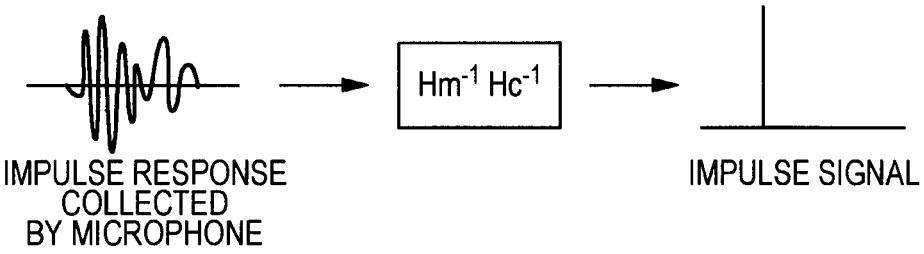
FIG. 7 is a diagram illustrating a relationship between an impulse response obtained by sound collection of the microphone of the output characteristic, and an impulse signal obtained by filtering of a filter with a characteristic obtained by combining the reverse characteristic of the output characteristic of the microphone and the reverse characteristic of the sound characteristic based on a structure.

FIG. 7 shows a relationship between the impulse response obtained by sound collection of the microphone 10 with the output characteristic Hm, and the impulse signal obtained by filtering with the filter obtained by combining the reverse characteristic $Hm^{-1}$ of the output characteristic Hm of the microphone 10 and the reverse characteristic $Hc^{-1}$ of the sound characteristic Hc based on the structure. From the relationship, it can be known that the filtering is performed by the correction filter characteristic obtained by combining the reverse characteristic $Hm^{-1}$ and the reverse characteristic $Hc^{-1}$ on the signal reaching the microphone 10 with the output characteristic Hm surrounded by the structure of the sound characteristic Hc, the frequency characteristic of the microphone 10 is thereby flattened, and it is possible to perform correction such that the phase characteristic is a linear phase.

(3) The correction filter characteristic is a characteristic obtained by combining the reverse characteristic $Hm^{-1}$ of the output characteristic Hm of the microphone 10 and a predetermined sound characteristic Hs.

The predetermined sound characteristic is, for example, a sound characteristic of the other microphone. As described above, the filtering is performed with the correction filter characteristic of the reverse characteristic $Hm^{-1}$ of the microphone 10 on the signal reaching the microphone 10 of the output characteristic Hm, the frequency characteristic of the microphone 10 is thereby flattened, and it is possible to perform correction such that the phase characteristic is a linear phase. By combining the predetermined sound characteristic Hs, it is possible to correct the sound characteristic of the microphone 10 to the predetermined sound characteristic Hs.

An operation of the signal processing apparatus 100 shown in FIG. 1 will be described. The signal acquired by the microphone 10 is amplified by the amplifier 101, is converted from an analog signal into a digital signal by the A/D converter 102, and then is supplied to the signal processing unit 103. In the signal processing unit 103, the filtering of the correction filter characteristic including the reverse characteristic $Hm^{-1}$ of the output characteristic Hm of the microphone 10 is performed on the output signal of the A/D converter 102, that is, the signal acquired by the microphone 10, thereby obtaining the output signal.

In this case, in the FFT unit 131, the signal acquired by the microphone 10 is converted from a signal on the time axis into a signal on the frequency axis. In the convolution integration unit 132, the correction filter (coefficient of correction filter) stored in the correction filter storing unit 134 is convolved on the frequency axis with respect to the output signal of the FFT unit 131. In the inverse FFT unit 133, the output signal of the convolution integration unit 132 is converted from a signal on the frequency axis into a signal on the time axis.

As described above, the correction filter characteristic is the reverse characteristic $Hm^{-1}$ of the output characteristic Hm of the microphone 10, in the signal processing unit 103, the frequency characteristic of the microphone 10 is flattened, and the correction is performed such that the phase characteristic is a linear phase. Accordingly, it is possible to improve the sound collection function.

As described above, the correction filter characteristic is the characteristic obtained by combining the reverse characteristic $Hm^{-1}$ of the output characteristic Hm of the microphone 10 and the reverse characteristic $Hc^{-1}$ of the sound characteristic Hc based on the structure surrounding the microphone 10, the frequency characteristic of the microphone 10 is flattened, and the correction is performed such that the phase characteristic is a linear phase, even when microphone 10 is surrounded by the structure. Accordingly, it is possible to perform sound correction which is not easily affected by the structure.

As described above, the correction filter characteristic is the characteristic obtained by combining the reverse characteristic $Hm^{-1}$ of the output characteristic Hm of the microphone 10 and the predetermined sound characteristic Hs, and thus the sound characteristic of the microphone 10 is corrected to the predetermined sound characteristic Hs in the signal processing unit 103. Accordingly, it is possible to combine the sound characteristic of the microphone 10 with, for example, the sound characteristic of the other microphone.

Figure 8:
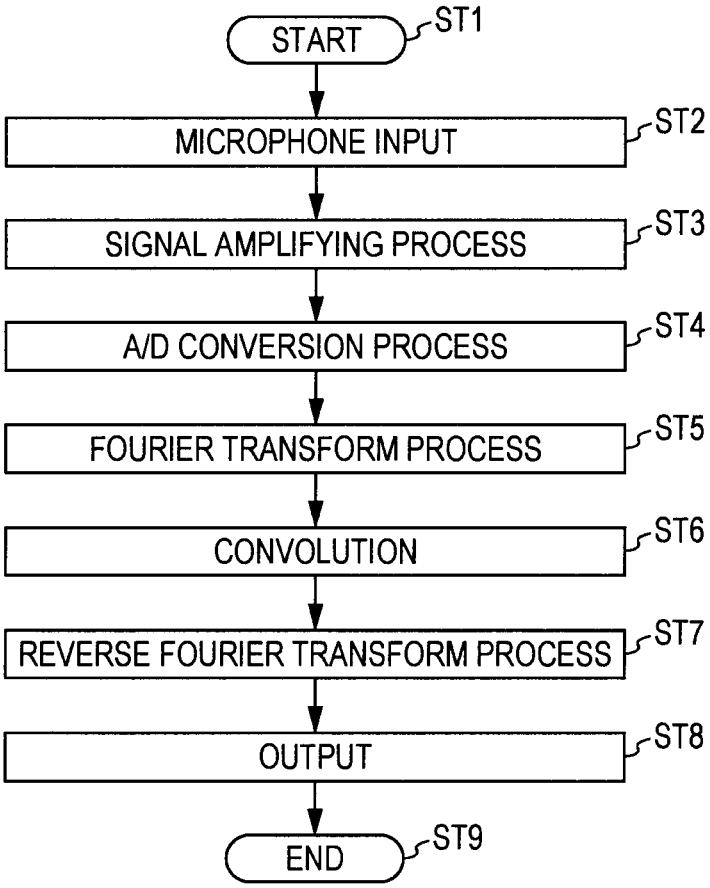
FIG. 8 is a flowchart illustrating an example of process sequence of the signal processing apparatus.

FIG. 8 is a flowchart illustrating a process sequence of the signal processing apparatus 100 shown in FIG. 1. In Step ST1, the signal processing apparatus 100 starts a process, and then transfer to a process of Step ST2. In Step ST2, the signal processing apparatus 100 inputs the signal acquired by the microphone 10.

Then, in Step ST3, the signal processing apparatus 100 amplifies the signal acquired by the microphone 10, and converts the amplified signal from an analog signal into a digital signal in Step ST4. In Step ST5, the signal processing apparatus 100 performs an FFT process of converting the signal acquired by the microphone 10 from signal data on the time axis into signal data on the frequency band.

Then, in Step ST6, the signal processing apparatus 100 convolves the correction filter coefficient in the signal data on the frequency axis, and performs a filtering process of the correction filter characteristic. In Step ST7, the signal processing apparatus 100 converts the signal data on the frequency axis after the filtering process into signal data on the time axis. The signal processing apparatus 100 outputs the signal after the filtering, and then ends the process in Step ST9.

In the signal processing apparatus 100 shown in FIG. 1, it is conceivable that the correction filter (coefficient of correction filter) stored in the correction filter storing unit 134 is the reverse characteristic $Hc^{-1}$ of the sound characteristic Hc based on the structure. In this case, it is possible to improve only the deterioration of the sound characteristic based on the structure.

<2. Second Embodiment>

[Example of Configuration of Signal Processing Apparatus]

Figure 9:
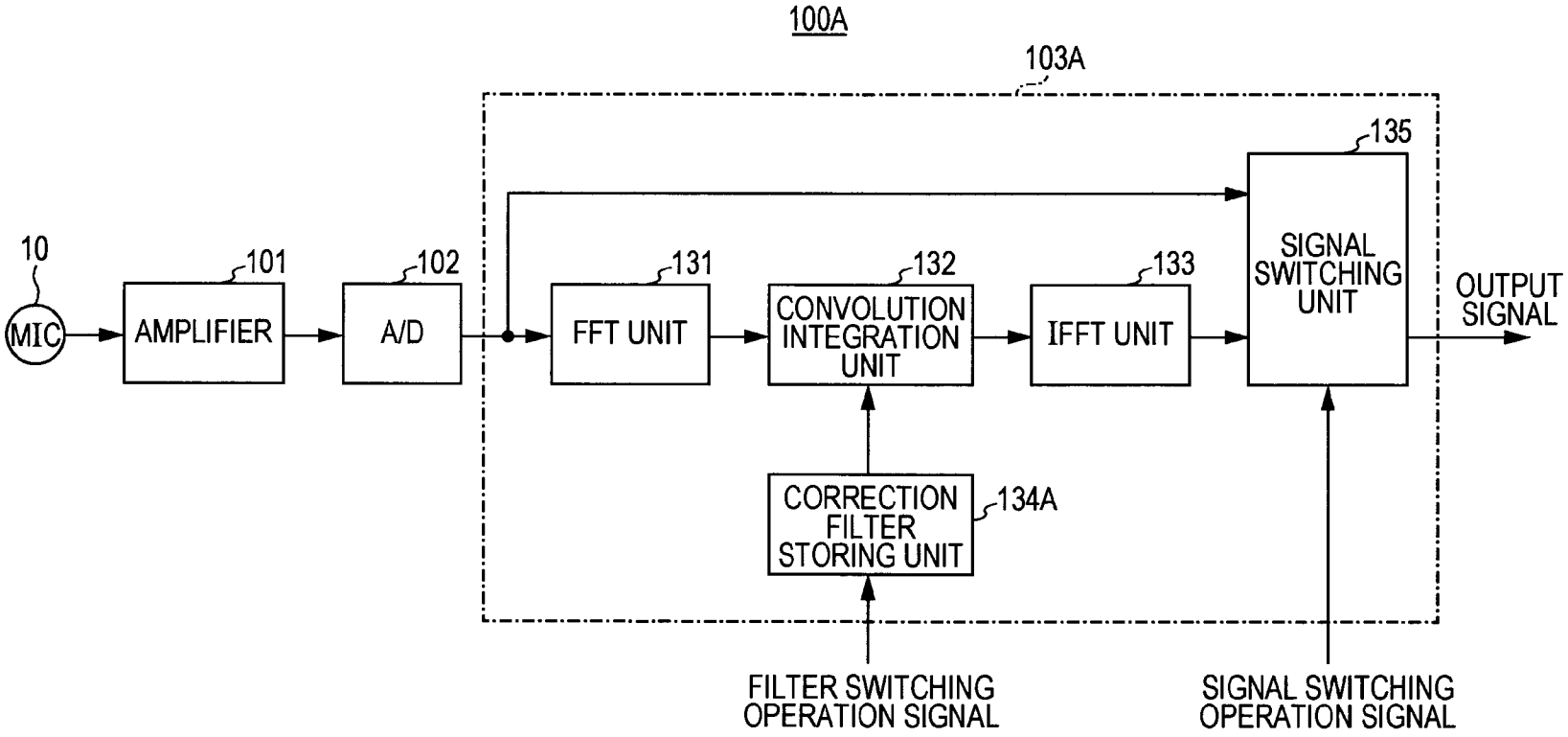
FIG. 9 is a block diagram illustrating an example of a configuration of a signal processing apparatus according to a second embodiment of the present disclosure.

FIG. 9 shows an example of a configuration of a signal processing apparatus 100A according to a second embodiment. In FIG. 9, the same reference numerals and signs are given to the parts corresponding to FIG. 1, and the description thereof is not repeated. The signal processing unit 100A includes an amplifier 101, an A/D converter 102, and a signal processing unit 103A.

The signal processing unit 103A includes an FFT unit 131, a convolution integration unit 132, an inverse FFT unit 133, and a correction filter storing unit 134A, and a signal switching unit 135. The correction filter storing unit 134A stores a plurality of correction filters (coefficient of correction filter). For example, the correction filters described in the following (1) to (3) are stored. The correction filter storing unit 134A selectively supplies any one to the convolution integration unit 132 on the basis of a filter switching operation signal based on a user operation.

(1) correction filter of reverse characteristic $Hm^{-1}$ of output characteristic Hm of microphone 10

(2) correction filter of characteristic obtained by combining reverse characteristic $Hm^{-1}$ of output characteristic Hm of microphone 10 and output characteristic of other microphone (3) correction filter of characteristic obtained by combining reverse characteristic $Hm^{-1}$ of output characteristic Hm of microphone 10 and sound characteristic in which low frequency response for blocking wind noise is decreased The signal switching unit 135 selective outputs the output signal of the A/D converter 102, that is, the signal acquired by the microphone 10, or the output signal of the reverse FFT unit 133, that is, the signal after the filter on the basis of the signal switching operation signal based on the user operation. The others of the signal processing unit 103A are configured by the same as the signal processing unit 103 in the signal processing apparatus 100 shown in FIG. 1.

An operation of the signal processing apparatus 100A shown in FIG. 9 will be described. The signal acquired by the microphone 10 is amplified by the amplifier 101, is converted from an analog signal into a digital signal by the A/D converter 102, and then is supplied to the signal processing unit 103A. In the signal processing unit 103A, the filtering corresponding to the correction filter (coefficient of correction filter) supplied from the correction filter storing unit 134A on the output signal of the A/D converter 102, that is, the signal acquired by the microphone 10, by the signal system of the FFT unit 131, the convolution integration unit 132, and the inverse FFT unit 133.

The output signal of the inverse FFT unit 133, that is, the signal after the filtering is supplied to the signal switching unit 135. The output signal of the A/D converter 102, that is, the signal acquired by the microphone 10 is supplied to the signal switching unit 135. In the signal switching unit 135, the signal acquired by the microphone 10 or the signal after the filtering is selectively output as the output signal on the basis of the signal switching operation signal.

In the signal processing apparatus 100A shown in FIG. 9, it is possible to selectively output the signal acquired by the microphone 10 or the signal after the filtering, as the output signal, by the switching operation of the signal switching unit 135. In the signal processing apparatus 100A, it is possible to output the signals subjected to the filtering with various correction filter characteristics, as the output signals, by the switching process of the correction filter. Accordingly, in the signal processing apparatus 100A, one microphone can take on a plurality of roles.

<3. Third Embodiment>

[Example of Configuration of Signal Processing Apparatus]

Figure 10:
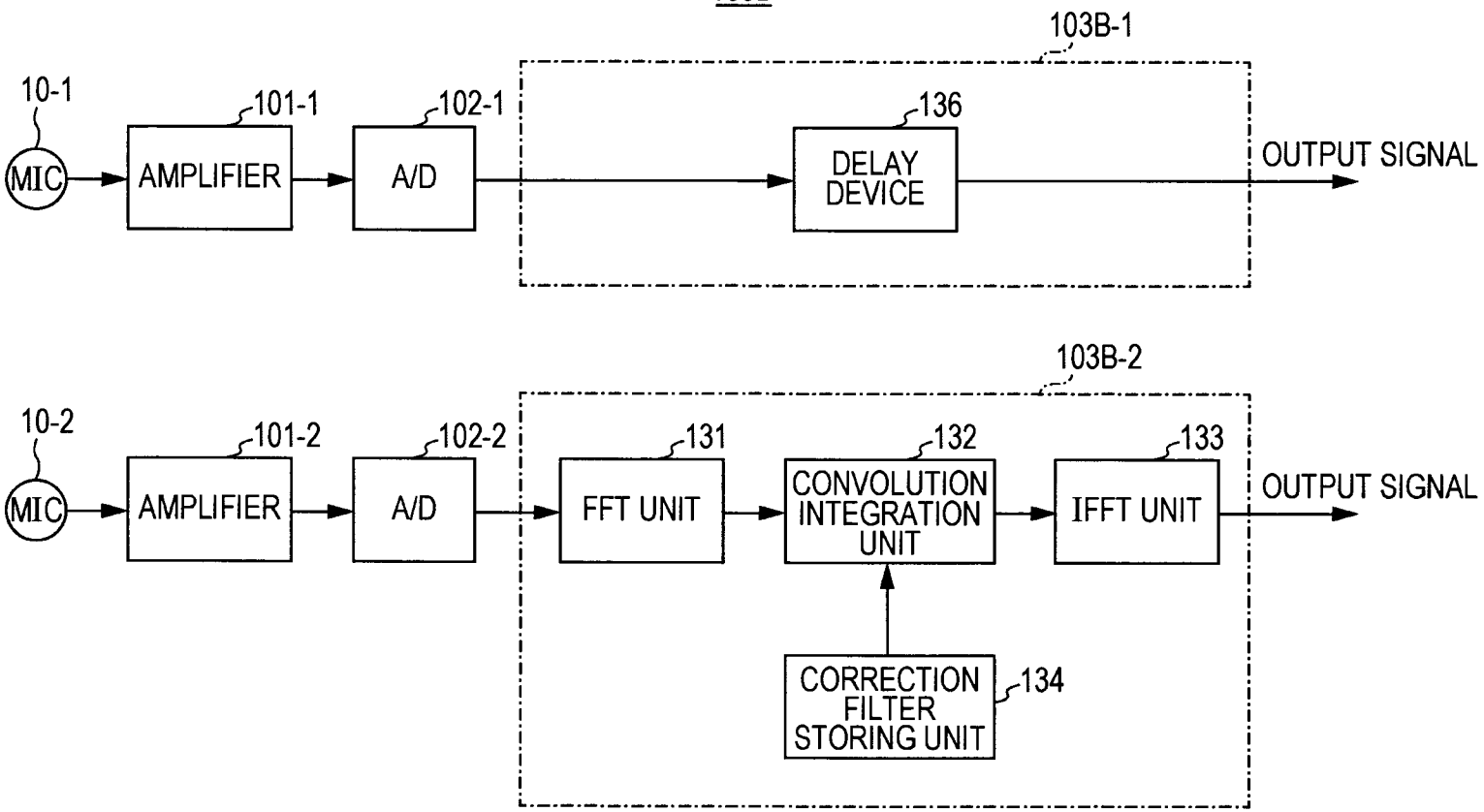
FIG. 10 is a block diagram illustrating an example of a configuration of a signal processing apparatus according to a third embodiment of the present disclosure.

FIG. 10 shows an example of a configuration of a signal processing apparatus 100B according to a third embodiment. In FIG. 10, the same reference numerals and signs are given to the parts corresponding to FIG. 1, and the description thereof is not repeated. The signal processing apparatus 100B is an example of performing a process on signals acquired by a plurality of microphones, in the embodiment, two microphones 10-1 and 10-2.

The signal processing apparatus 100B includes amplifiers 101-1 and 101-2, A/D converters 102-1 and 102-2, and signal processing units 103B-1 and 103B-2. The amplifier 101-1 amplifiers the signal acquired by the microphone 10-1. The A/D converter 102-1 converts the output signal of the amplifier 101-1 from an analog signal from a digital signal. The signal processing unit 103B-1 has a delay device 136. The delay device 136 delays the output signal of the A/D converter 102-1, that is, the signal acquired by the microphone 10-1 by time corresponding to a process delay in the signal processing unit 103B-2 to be described later, and outputs the signal as the output signal.

The amplifier 101-2 amplifiers the signal acquired by the microphone 10-2. The A/D converter 102-2 converts the output signal of the amplifier 101-2 from an analog signal from a digital signal. The signal processing unit 103B-2 has a filter (FIR filter) performing filtering on the output signal of the A/D converter 102-2, that is, the signal acquired by the microphone 10-2. The signal processing unit 103B-2 performs the filtering of the characteristic (correction filter characteristic) obtained by combining the reverse characteristic $Hm^{-1}$ of the output characteristic Hm of the microphone 10-2 and the output characteristic Hm' of the microphone 10-1 on the output signal of the A/D converter 102-2, that is, the signal acquired by the microphone 10-2, and outputs the signal after the filtering.

An operation of the signal processing apparatus 100B shown in FIG. 10 will be described. The signal acquired by the microphone 10-2 is amplified by the amplifier 101-2, is converted from an analog signal into a digital signal by the A/D converter 102-2, and then is supplied to the signal processing unit 103B-2. In the signal processing unit 103B-2, the filtering of the characteristic obtained by combining the reverse characteristic $Hm^{-1}$ of the output characteristic Hm of the microphone 10-2 and the output characteristic Hm' of the microphone 10-1 is performed on the output signal of the A/D converter 102-2, that is, the signal acquired by the microphone 10-2. The signal after the filtering in the signal processing unit 103B-2 is output as the output signal.

In this case, the correction filter characteristic is the characteristic obtained by combining the reverse characteristic $Hm^{-1}$ of the output characteristic Hm of the microphone 10-2 and the output characteristic Hm' of the microphone 10-1.

Accordingly, in the signal processing unit 103B-2, the sound characteristic of the microphone 10-2 is corrected to the sound characteristic Hm' of the microphone 10-1. Accordingly, it is possible to combine the sound characteristic of the microphone 10-2 with the sound characteristic of the microphone 10-1.

The signal acquired by the microphone 10-1 is amplified by the amplifier 101-1, is converted from an analog signal into a digital signal by the A/D converter 102-1, and then is supplied to the signal processing unit 103B-1. In the signal processing unit 103B-1, the output signal of the A/D converter 102-1, that is, the signal acquired by the microphone 10-1 is delayed by time corresponding to a process delay in the signal processing unit 103B-2, and then is output as the output signal.

As described above, in the signal processing apparatus 100B shown in FIG. 10, it is possible to combine the sound characteristic of the microphone 10-2 with the sound characteristic of the microphone 10-1 by a filter with a constant group delay characteristic provided at the subsequent stage of the microphone 10-2. That is, since the sound characteristics (frequency characteristic and phase characteristic) of the microphones 10-1 and 10-2 are the same, it is possible to perform satisfactory recording in two channels.

<4. Fourth Embodiment>

[Example of Configuration of Signal Processing Apparatus]

Figure 11:
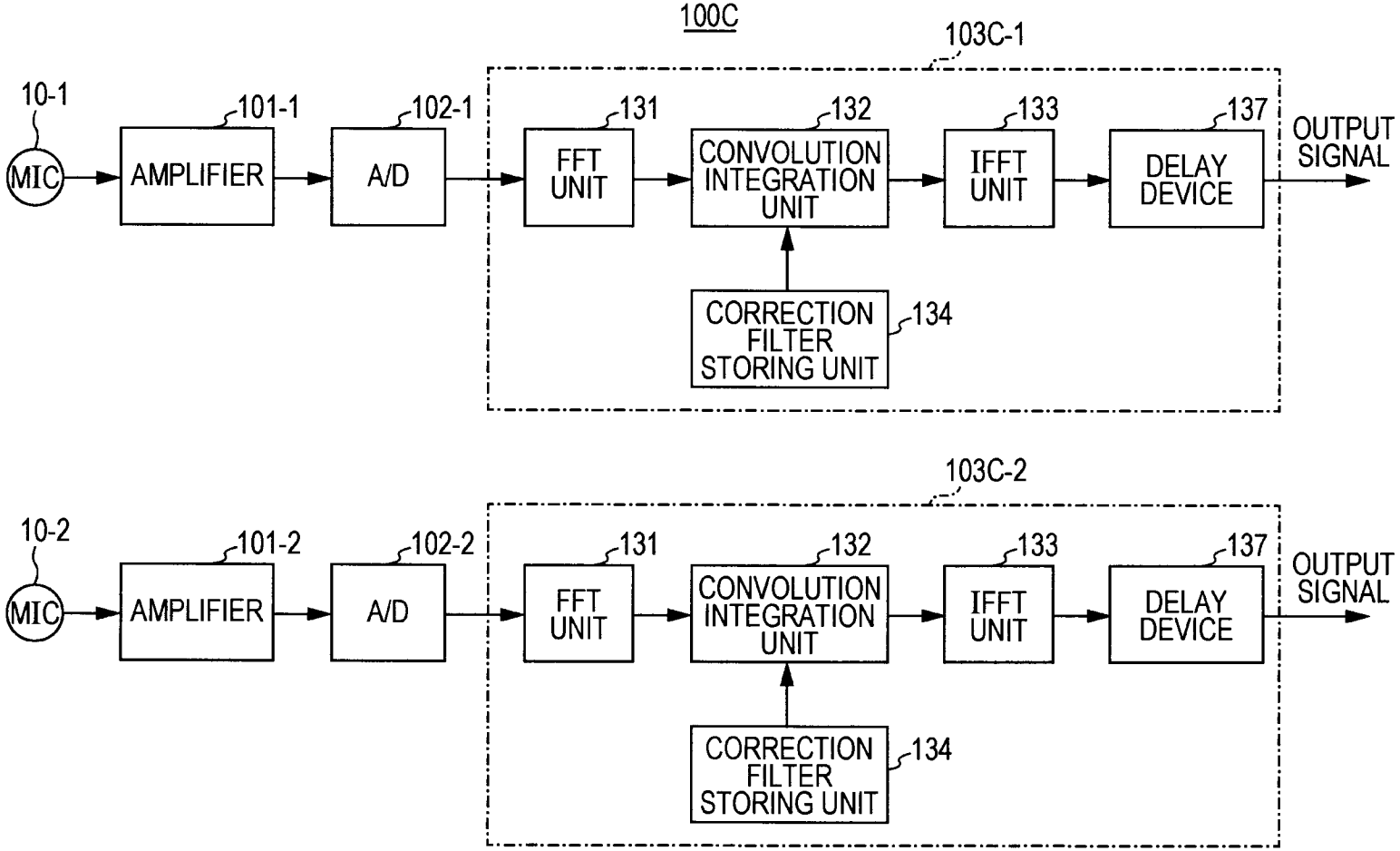
FIG. 11 is a block diagram illustrating an example of a configuration of a signal processing apparatus according to a fourth embodiment of the present disclosure.

FIG. 11 shows an example of a configuration of a signal processing apparatus 100C according to a fourth embodiment. In FIG. 11, the same reference numerals and signs are given to the parts corresponding to FIG. 1 and FIG. 10, and the description thereof is not repeated. The signal processing apparatus 100C is an example of performing a process on the signals acquired by a plurality of microphones, in the embodiment, two microphones 10-1 and 10-2.

The signal processing apparatus 100C includes amplifiers 101-1 and 101-2, A/D converters 102-1 and 102-2, and signal processing units 103C-1 and 103C-2. The signal processing unit 103C-1 has a filter (FIR filter) performing filtering on the output signal of the A/D converter 102-1, that is, the signal acquired by the microphone 10-1. The filter performs the filtering with the correction filter characteristic of the reverse characteristic $Hm^{-1}$ of the output characteristic Hm of the microphone 10-1.

That is, the signal processing unit 103C-1 includes an FFT unit 131, a convolution integration unit 132, an inverse FFT unit 133, a correction filter storing unit 134, and a delay device 137. The correction filter characteristic stored in the correction filter storing unit 134 is the reverse characteristic $Hm^{-1}$ of the output characteristic Hm of the microphone 10-1. The delay device 137 is a delay device for timing adjustment to combine the output signal of the signal processing unit 103C-1 and the output signal of the signal processing unit 103C-2.

The signal processing unit 103C-2 has a filter (FIR filter) performing filtering on the output signal of the A/D converter 102-2, that is, the signal acquired by the microphone 10-2. The filter performs the filtering with the correction filter characteristic of the reverse characteristic $Hm^{-1}$ of the output characteristic Hm of the microphone 10-2.

That is, similarly to the signal processing unit 103C-1 described above, the signal processing unit 103C-2 includes an FFT unit 131, a convolution integration unit 132, an inverse FFT unit 133, a correction filter storing unit 134, and a delay device 137. The correction filter characteristic stored in the correction filter storing unit 134 is the reverse characteristic $Hm^{-1}$ of the output characteristic Hm of the microphone 10-2. The delay device 137 is a delay device for timing adjustment to combine the output signal of the signal processing unit 103C-2 and the output signal of the signal processing unit 103C-1.

In the signal processing apparatus 100C shown in FIG. 11, both of the signal processing units 103C-1 and 103C-2 have the delay device 137. However, actually, it may be sufficient that it is provided on the side with a fast process time between the signal processing units 103C-1 and 103C-2. When the correction filter characteristics of the filters of the signal processing units 103C-1 and 103C-2 are the same and the process delay times of the signal processing units 103C-1 and 103C-2 are the same, both do not include the delay device 137. The delay for timing adjustment is set in the filter in advance, and thus the signal processing units 103C-1 and 103C-2 may have a configuration which does not include the delay device 137.

An operation of the signal processing apparatus 100C shown in FIG. 11 will be described. The signal acquired by the microphone 10-1 is amplified by the amplifier 101-1, is converted from an analog signal into a digital signal by the A/D converter 102-1, and then is supplied to the signal processing unit 103C-1. In the signal processing unit 103C-1, the filtering of the reverse characteristic $Hm^{-1}$ of the output characteristic Hm of the microphone 10-1 is performed on the output signal of the A/D converter 102-1, that is, the signal acquired by the microphone 10-1.

The signal after the filtering in the signal processing unit 103C-1 is output as the output signal after the timing adjustment by the delay device 137. In this case, the correction filter characteristic is the reverse characteristic $Hm^{-1}$ of the output characteristic Hm of the microphone 10-1, the frequency characteristic of the microphone 10-1 is flattened in the signal processing unit 103C-1, and the correction is performed such that the phase characteristic is a linear phase.

The signal acquired by the microphone 10-2 is amplified by the amplifier 101-2, is converted from an analog signal into a digital signal by the A/D converter 102-2, and then is supplied to the signal processing unit 103C-2. In the signal processing unit 103C-2, the filtering of the reverse characteristic $Hm^{-1}$ of the output characteristic Hm of the microphone 10-2 is performed on the output signal of the A/D converter 102-2, that is, the signal acquired by the microphone 10-2.

The signal after the filtering in the signal processing unit 103C-2 is output as the output signal after the timing adjustment by the delay device 137. In this case, the correction filter characteristic is the reverse characteristic $Hm^{-1}$ of the output characteristic Hm of the microphone 10-2, the frequency characteristic of the microphone 10-2 is flattened in the signal processing unit 103C-2, and the correction is performed such that the phase characteristic is a linear phase.

As described above, in the signal processing apparatus 100C shown in FIG. 11, in the sound characteristics of the microphones 10-1 and 10-2, the frequency characteristic is flattened by a filter with a constant group delay characteristic provided at the subsequent stage of the microphones 10-1 and 10-2, and the correction is performed such that the phase characteristic is a linear phase. That is, since the sound characteristics (frequency characteristic and phase characteristic) of the microphones 10-1 and 10-2 are the same, it is possible to perform satisfactory recording in two channels.

In the above description, the correction filter characteristics stored in the correction filter storing units 134 of the signal processing units 103C-1 and 103C-2 are the reverse characteristic $Hm^{-1}$ of the output characteristic Hm of the microphones 10-1 and 10-2. However, it is conceivable that the correction filter characteristics stored in the correction filter storing units 134 of the signal processing units 103C-1 and 103C-2 are the characteristic obtained by combining the reverse characteristic $Hm^{-1}$ of the output characteristic Hm of the microphone 10-1 and 10-2 and a predetermined sound characteristic. Even in this case, the sound characteristics of the microphones 10-1 and 10-2 are corrected to the predetermined sound characteristic, the sound characteristics (frequency characteristic and phase characteristic) are the same, and it is possible to perform satisfactory recording in two channels.

<5. Fifth Embodiment>

[Example of Configuration of Signal Processing Apparatus]

Figure 12:
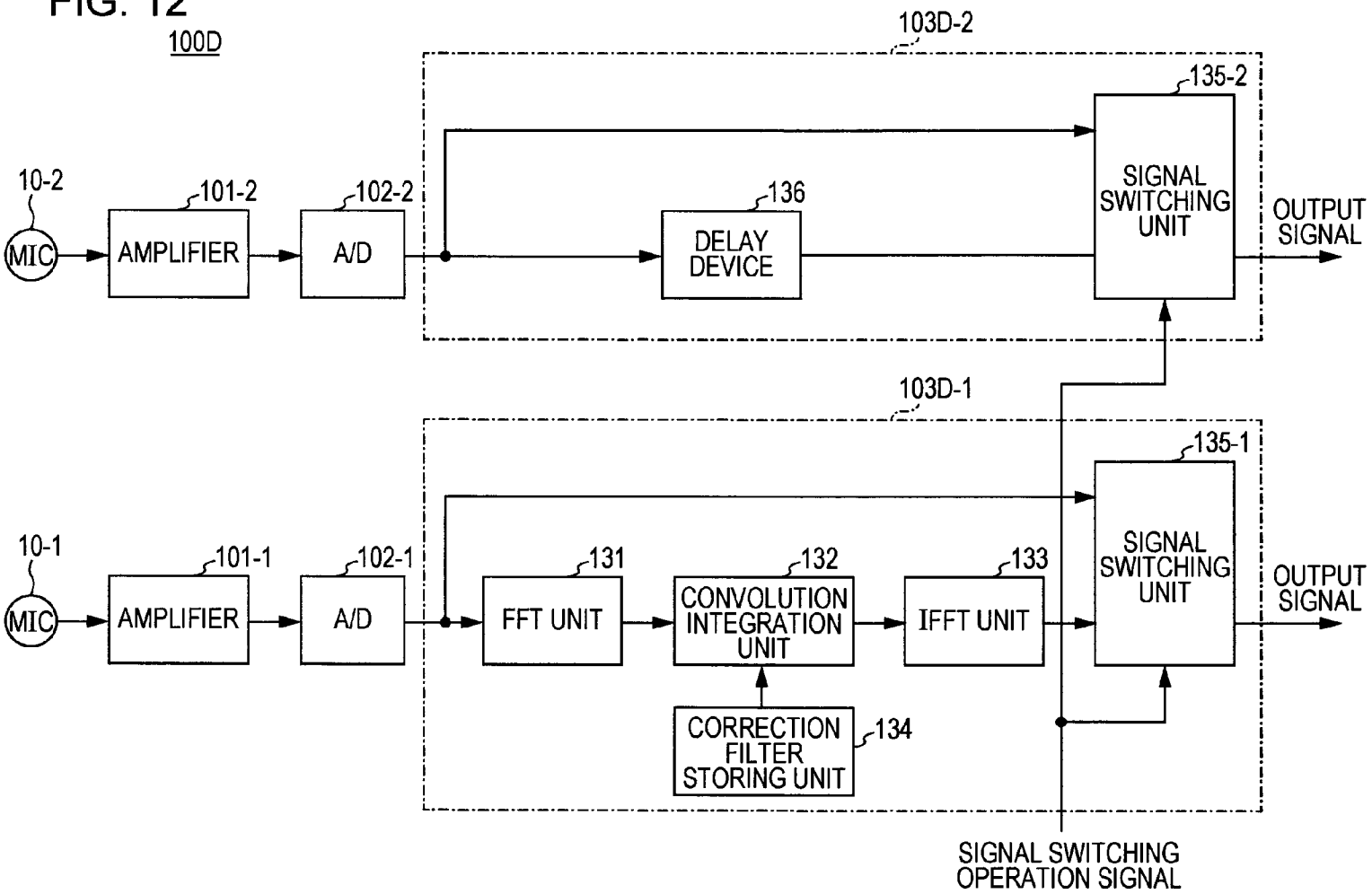
FIG. 12 is a block diagram illustrating an example of a configuration of a signal processing apparatus according to a fifth embodiment of the present disclosure.

FIG. 12 shows an example of a configuration of a signal processing apparatus 100D according to a fifth embodiment. In FIG. 12, the same reference numerals and signs are given to the parts corresponding to FIG. 1 and FIG. 10, and the description thereof is not repeated.

Figure 13:
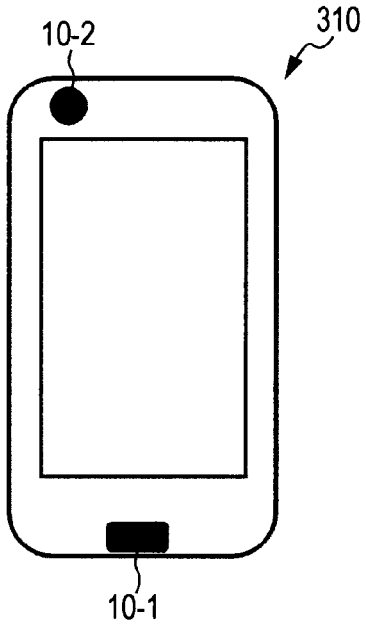
FIG. 13 is a diagram illustrating a mobile phone having a phone call microphone and a noise cancel full band microphone.
Figure 14A:
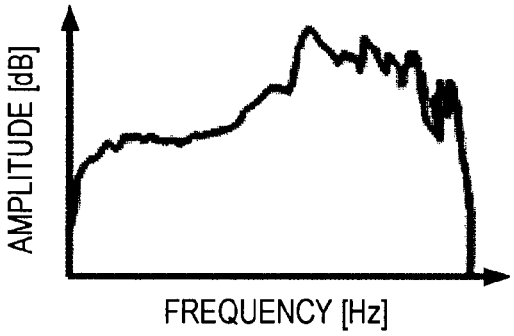
FIG. 14A and FIG. 14B are diagrams illustrating an example of a frequency characteristic of the phone call microphone and a frequency characteristic of the noise cancel full band microphone.
Figure 14B:
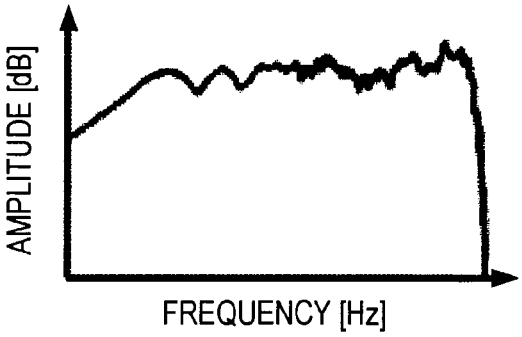

As shown in FIG. 13, the signal processing apparatus 100D is an application example of a mobile phone 310 having a phone call microphone 10-1 and a noise cancel full band microphone 10-2. FIG. 14A shows a frequency characteristic of the phone call microphone 10-1. FIG. 14B show a frequency characteristic of the noise cancel full band microphone 10-2. In the example, at the time of phone call, the phone call microphone 10-1 and the noise cancel full band microphone 10-2 are used for the original usages at the time of phone call.

The signal processing apparatus 100D shown in FIG. 12 includes amplifiers 101-1 and 101-2, A/D converters 102-1 and 102-2, and signal processing units 103D-1 and 103D-2. The amplifier 101-1 amplifiers the signal acquired by the microphone 10-1. The A/D converter 102-1 converts the output signal of the amplifier 101-1 from an analog signal from a digital signal.

The signal processing unit 103D-1 has a filter (FIR filter) performing filtering on the output signal of the A/D converter 102-1, that is, the signal acquired by the microphone 10-1. The signal processing unit 103D-1 outputs the output signal itself of the A/D converter 102-1 at the time of phone call. Meanwhile, at the time of recording of two channels, the filtering of the characteristic (correction filter characteristic) obtained by combining the reverse characteristic $Hm^{-1}$ of the output characteristic Hm of the microphone 10-1 and the output characteristic Hm' of the microphone 10-2 is performed on the output signal of the A/D converter 102-1, that is, the signal acquired by the microphone 10-1, and outputs the signal after the filtering.

That is, the signal processing unit 103D-1 includes an FFT unit 131, a convolution integration unit 132, an inverse FFT unit 133, a correction filter storing unit 134, and a signal switching unit 135-1. The correction filter storing unit 134 stores the correction filter (coefficient of correction filter) obtained by combining the reverse characteristic $Hm^{-1}$ of the output characteristic Hm of the microphone 10-1 and the output characteristic Hm' of the microphone 10-2.

The signal switching unit 135-1 selectively outputs the output signal of the A/D converter 102-1, that is, the signal acquired by the microphone 10-1, or the output signal of the inverse FFT unit 133, that is, the signal after the filtering on the basis of the signal switching operation signal based on the user operation. That is, the signal switching unit 135-1 outputs the signal acquired by the microphone 10-1 at the time of phone call. Meanwhile, the signal switching unit 135-1 outputs the signal after the filter at the time of recording of two channels.

The signal processing unit 103D-2 includes a delay device 136 and a signal switching unit 135-2. The delay device 136 performs a delay process on the output signal of the A/D converter 102-2, that is, the signal acquired by the microphone 10-2. The delay device 136 delays the output signal of the A/D converter 102-2, that is, the signal acquired by the microphone 10-2 by time corresponding to a process delay in the signal processing unit 103D-1 described above to adjust the timing.

The signal switching unit 135-2 selectively outputs the output signal of the A/D converter 102-2, that is, the signal acquired by the microphone 10-2, or the output signal of the delay device 136, that is, the signal after the delay process on the basis of the signal switching operation signal based on the user operation. That is, the signal switching unit 135-2 outputs the signal acquired by the microphone 10-2 at the time of phone call. Meanwhile, the signal switching unit 135-2 outputs the output signal of the delay device 136 at the time of recording of two channels.

An operation of the signal processing apparatus 100D shown in FIG. 12 will be described. First, an operation at the time of phone call will be described. The signal acquired by the phone call microphone 10-1 is amplified by the amplifier 101-1, is converted from an analog signal into a digital signal by the A/D converter 102-1, and then is supplied to the signal processing unit 103D-1. The output signal of the A/D converter 102-1, that is, the signal acquired by the microphone 10-1 is output from the signal switching unit 135-1, as the output signal.

The signal acquired by the noise cancel full band microphone 10-2 is amplified by the amplifier 101-2, is converted from an analog signal into a digital signal by the A/D converter 102-2, and then is supplied to the signal processing unit 103D-2. The output signal of the A/D converter 102-2, that is, the signal acquired by the microphone 10-2 is output from the signal switching unit 135-2, as the output signal.

Next, an operation at the time of recording of two channels will be described. The signal acquired by the phone call microphone 10-1 is amplified by the amplifier 101-1, is converted from an analog signal into a digital signal by the A/D converter 102-1, and then is supplied to the signal processing unit 103D-1. In the signal processing unit 103D-1, the filtering of the characteristic (correction filter characteristic) obtained by combining the reverse characteristic $Hm^{-1}$ of the output characteristic Hm of the microphone 10-1 and the output characteristic Hm' of the microphone 10-2 is performed on the output signal of the A/D converter 102-1, that is, the signal acquired by the microphone 10-1. The signal after the filtering is output from the signal switching unit 135-1, as the output signal.

In this case, the correction filter characteristic is the characteristic obtained by combining the reverse characteristic $Hm^{-1}$ of the output characteristic Hm of the microphone 10-1 and the output characteristic Hm' of the microphone 10-2. Accordingly, in the signal processing unit 103D-1, the sound characteristic of the microphone 10-1 is corrected to the sound characteristic Hm' of the microphone 10-2. Accordingly, it is possible to combine the sound characteristic of the phone call microphone 10-1 with the sound characteristic of the noise cancel full band microphone 10-2.

The signal acquired by the noise cancel full band microphone 10-2 is amplified by the amplifier 101-2, is converted from an analog signal into a digital signal by the A/D converter 102-2, and then is supplied to the signal processing unit 103D-2. In the signal processing unit 103D-2, the output signal of the A/D converter 102-2, that is, the signal acquired by the microphone 10-2 is delayed by time corresponding to a process delay in the signal processing unit 103D-1 by the delay device 136. The signal subjected to the delay process by the delay device 136 is output from the signal switching unit 135-2, as the output signal.

As described above, the signal processing apparatus 100D shown in FIG. 12, at the time of recording of two channels, it is possible to combine the sound characteristic of the phone call microphone 10-1 with the sound characteristic of the noise cancel full band microphone 10-2 by the filter with a constant group delay characteristic. For this reason, since the sound characteristics (frequency characteristic and phase characteristic) of the microphones 10-1 and 10-2 are the same, it is possible to perform satisfactory recording in two channels. That is, in the signal processing apparatus 100D shown in FIG. 12, it is possible to perform the recording of two channels in the microphones with different usages.

<6. Sixth Embodiment>

[Example of Configuration of Signal Processing Apparatus]

Figure 15:
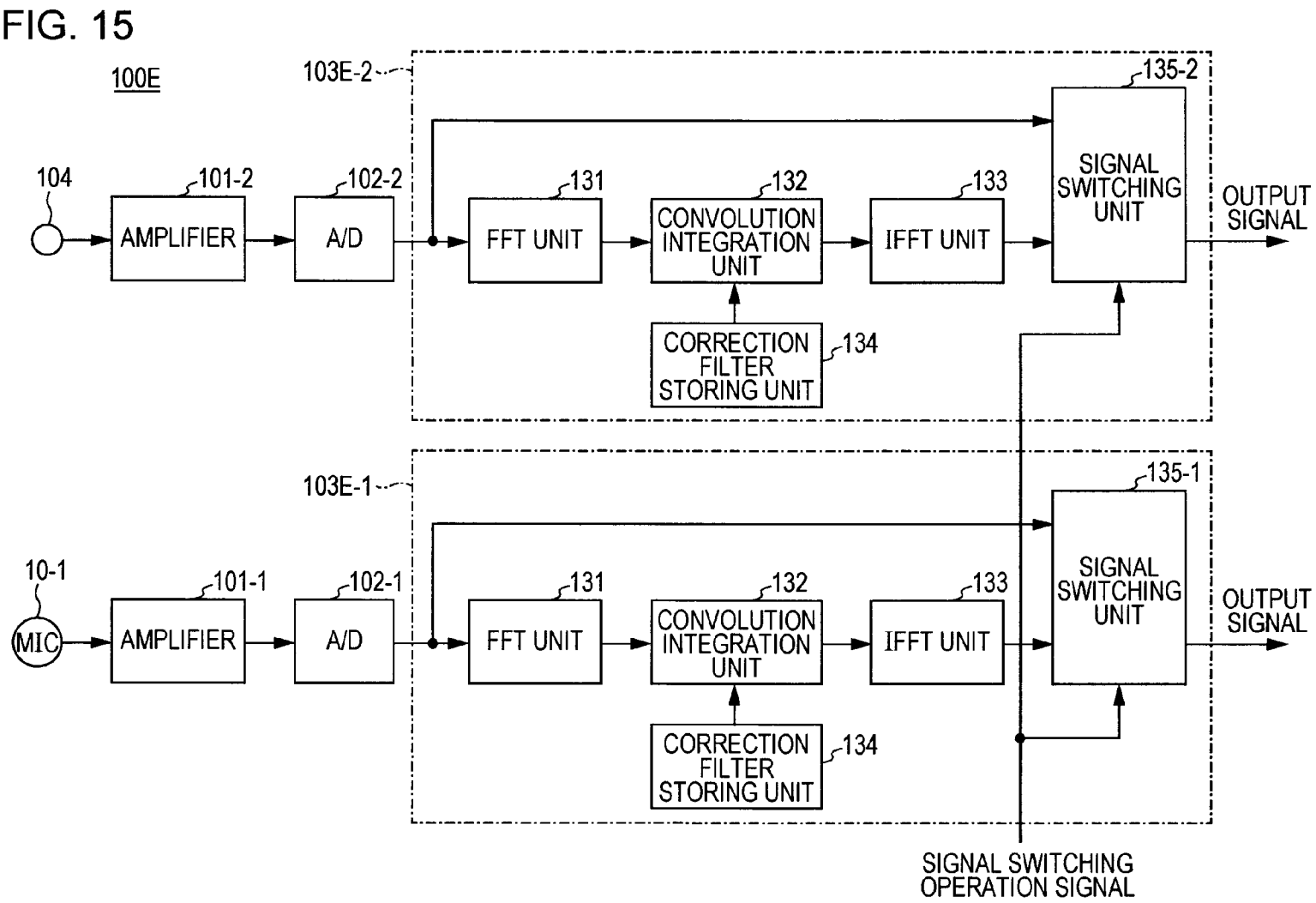
FIG. 15 is a block diagram illustrating an example of a configuration of a signal processing apparatus according to a sixth embodiment of the present disclosure.

FIG. 15 shows an example of a configuration of a signal processing apparatus 100E according to a sixth embodiment. In FIG. 15, the same reference numerals and signs are given to the parts corresponding to FIG. 1 and FIG. 12, and the description thereof is not repeated.

Figure 16:
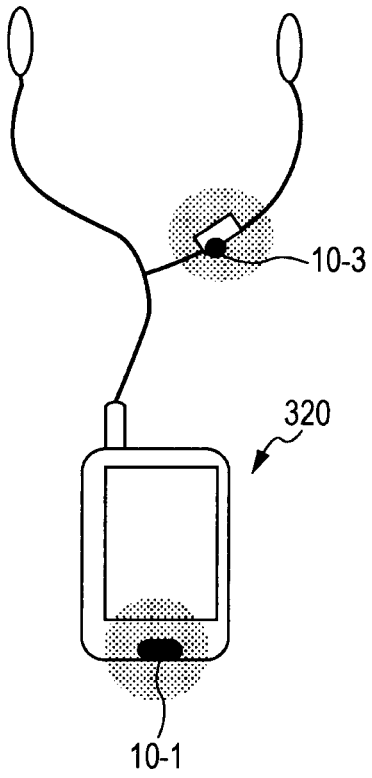
FIG. 16 is a diagram illustrating a mobile phone capable of using a phone call microphone and a hands-free phone call microphone provided in a hands-free headphone to collect a sound in a voice band.

As shown in FIG. 16, the signal processing apparatus 100E is an application example of a mobile phone 320 capable of using a phone call microphone 10-1 and a hands-free phone call microphone 10-3 to collect a sound in a voice band provided in a hands-free headphone. In the example, at the time of phone call, the phone call microphone 10-1 or the hands-free phone call microphone 10-3 are used for the original usages at the time of phone call.

The signal processing apparatus 100D shown in FIG. 15 includes an input terminal 104 for inputting a signal acquired by the hand-free phone call microphone 10-3, amplifiers 101-1 and 101-2, A/D converter 102-1 and 102-2, and signal processing units 103E-1 and 103E-2. The amplifier 101-1 amplifiers the signal acquired by the phone call microphone 10-1. The A/D converter 102-1 converts the output signal of the amplifier 101-1 from an analog signal from a digital signal.

The signal processing unit 103E-1 has a filter (FIR filter) performing filtering on the output signal of the A/D converter 102-1, that is, the signal acquired by the microphone 10-1. The signal processing unit 103E-1 outputs the output signal itself of the A/D converter 102-1 at the time of phone call. Meanwhile, at the time of recording of two channels, the filtering of the reverse characteristic $Hm^{-1}$ of the output characteristic Hm of the microphone 10-1 is performed on the signal acquired by the microphone 10-1 on the signal acquired by the output signal of the A/D converter 102-1, that is, the signal acquired by the microphone 10-1.

That is, the signal processing unit 103E-1 includes an FFT unit 131, a convolution integration unit 132, an inverse FFT unit 133, a correction filter storing unit 134, and a signal switching unit 135-1. The correction filter storing unit 134 stores the correction filter (coefficient of correction filter) of the reverse characteristic $Hm^{-1}$ of the output characteristic Hm of the microphone 10-1.

The signal switching unit 135-1 selectively outputs the output signal of the A/D converter 102-1, that is, the signal acquired by the microphone 10-1, or the output signal of the inverse FFT unit 133, that is, the signal after the filtering on the basis of the signal switching operation signal based on the user operation. That is, signal switching unit 135-1 outputs the signal acquired by the microphone 10-1. Meanwhile, the signal switching unit 135-1 outputs the signal after the filtering at the time of recording of two channels.

The signal processing unit 103E-2 has a filter (FIR filter) performing filtering on the output signal of the A/D converter 102-2, that is, the signal acquired by the hands-free microphone 10-3 (see FIG. 16). The signal processing unit 103E-2 outputs the output signal itself of the A/D converter 102-2 at the time of phone call. Meanwhile, at the time of recording of two channels, the filtering of the reverse characteristic $Hm^{-1}$ of the output characteristic Hm of the microphone 10-3 is performed on the output signal of the A/D converter 102-2, that is, the signal acquired by the microphone 10-3, and outputs the signal after the filtering.

That is, the signal processing unit 103E-2 includes an FFT unit 131, a convolution integration unit 132, an inverse FFT unit 133, a correction filter storing unit 134, and a signal switching unit 135-2. The correction filter storing unit 134 stores the correction filter (coefficient of correction filter) of the reverse characteristic $Hm^{-1}$ of the output characteristic Hm of the microphone 10-3.

The signal switching unit 135-2 selectively outputs the output signal of the A/D converter 102-2, that is, the signal acquired by the microphone 10-2, or the output signal of the inverse FFT unit 133, that is, the signal after the filtering on the basis of the signal switching operation signal based on the user operation. That is, the signal switching unit 135-2 outputs the signal acquired by the microphone 10-3 at the time of phone call. Meanwhile, the signal switching unit 135-2 outputs the signal after the filter at the time of recording of two channels.

An operation of the signal processing apparatus 100E shown in FIG. 15 will be described. First, an operation at the time of phone call will be described. The signal acquired by the phone call microphone 10-1 is amplified by the amplifier 101-1, is converted from an analog signal into a digital signal by the A/D converter 102-1, and then is supplied to the signal processing unit 103D-1. The output signal of the A/D converter 102-1, that is, the signal acquired by the microphone 10-1 is output from the signal switching unit 135-1, as the output signal.

The signal acquired by the hands-free phone call microphone 10-3 input to the input terminal 104 is amplified by the amplifier 101-2, is converted from an analog signal into a digital signal by the A/D converter 102-2, and then is supplied to the signal processing unit 103E-2. The output signal of the A/D converter 102-2, that is, the signal acquired by the microphone 10-3 is output from the signal switching unit 135-2, as the output signal.

Next, an operation at the time of recording of two channels will be described. The signal acquired by the phone call microphone 10-1 is amplified by the amplifier 101-1, is converted from an analog signal into a digital signal by the A/D converter 102-1, and then is supplied to the signal processing unit 103E-1. In the signal processing unit 103E-1, the filtering of the reverse characteristic $Hm^{-1}$ of the output characteristic Hm of the microphone 10-1 on the output signal of the A/D converter 102-1, that is, the signal acquired by the microphone 10-1. The signal after the filtering is output from the signal switching unit 135-1, as the output signal. In this case, the correction filter characteristic is the reverse characteristic $Hm^{-1}$ of the output characteristic Hm of the microphone 10-1. Accordingly, in the signal processing unit 103E-1, the frequency characteristic of the microphone 10-1 is flattened, and the correction is performed such that the phase characteristic is a linear phase.

The signal acquired by the hands-free phone microphone 10-3 is amplified by the amplifier 101-2, is converted from an analog signal into a digital signal by the A/D converter 102-2, and then is supplied to the signal processing unit 103E-2. In the signal processing unit 103E-2, the filtering of the reverse characteristic $Hm^{-1}$ of the output characteristic Hm of the microphone 10-3 is performed on the output signal of the A/D converter 102-2, that is, the signal acquired by the microphone 10-3. The signal after the filtering is output from the signal switching unit 135-2, as the output signal. In this case, the correction filter characteristic is characteristic $Hm^{-1}$ of the output characteristic Hm of the microphone 10-3. Accordingly, in the signal processing unit 103E-2, the frequency characteristic of the microphone 10-3 is flattened, and the correction is performed such that the phase characteristic is a linear phase.

As described above, the signal processing apparatus 100E shown in FIG. 15, at the time of recording of two channels, the sound characteristics of the phone call microphones 10-1 and 10-3 are corrected such that the frequency characteristic is flattened and the phase characteristic is linear phase by the filter with a constant group delay characteristic. For this reason, since the sound characteristics (frequency characteristic and phase characteristic) of the microphones 10-1 and 10-3 are the same, it is possible to perform satisfactory recording in two channels. That is, in the signal processing apparatus 100E shown in FIG. 15, it is possible to perform the recording of two channels in the microphones with different usages.

Figure 17:
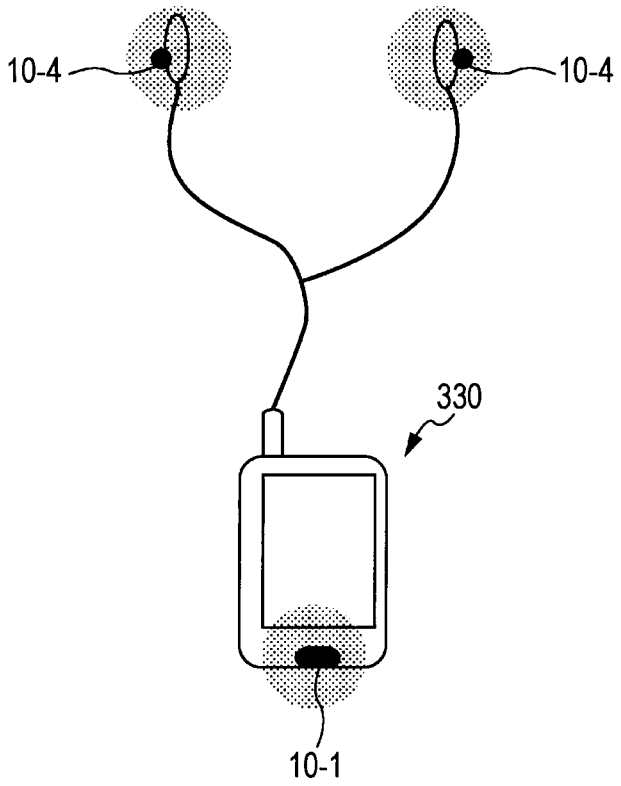
FIG. 17 is a diagram illustrating a mobile phone capable of using a phone call microphone and a noise cancel microphone provided in a noise cancel headphone to collect a sound in a voice band.
Figure 18:
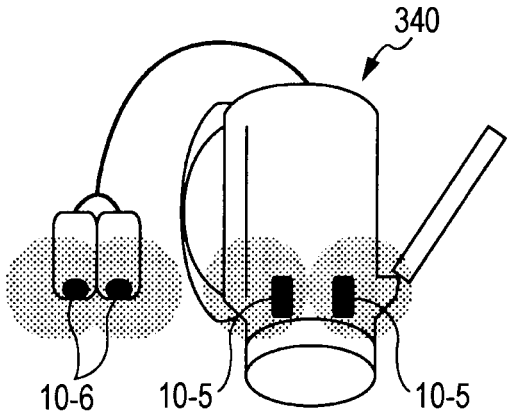
FIG. 18 is a diagram illustrating a video camera capable of using a body built-in microphone and an external attached microphone.

As shown in FIG. 17, the signal processing apparatus 100E shown in FIG. 15 may be applied to a mobile phone 330 capable of using a phone call microphone 10-1 and a noise cancel microphone 10-4 to collect a sound in the voice band provided in a noise cancel headphone. In this case, it is possible to satisfactorily perform recording of three channels. As shown in FIG. 18, the signal processing apparatus 100E shown in FIG. 15 may be applied to a video camera 340 capable of using body built-in microphones 10-5 and 10-5 and external attached microphones 10-6 and 10-6. In this case, it is possible to satisfactorily perform recording of four channels.

Figure 19:
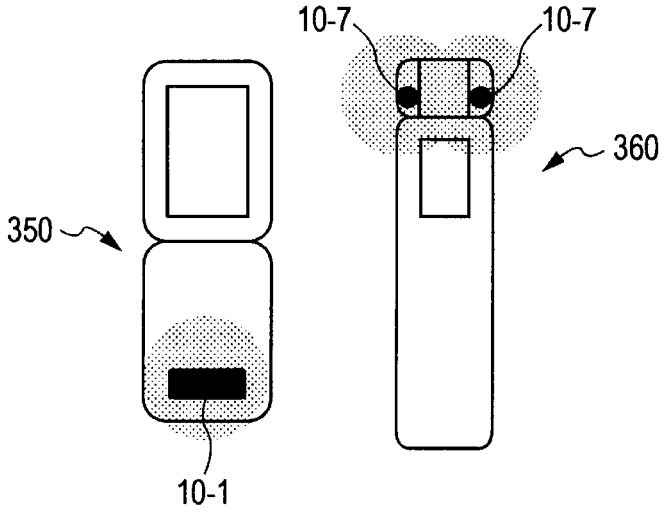
FIG. 19 is a diagram illustrating a mobile phone capable of using a phone call microphone and an IC recorder capable of using a recording microphone.

As shown in FIG. 19, the signal processing apparatus 100E shown in FIG. 15 may be applied to a mobile terminal 350 capable of using the phone call microphone 10-1 and an IC recorder 360 capable of using recording microphones 10-7 and 10-7. In this case, it is possible to satisfactorily perform recording of three channels using the time synchronization method of the related art using a time stamp or the like.

<7. Seventh Embodiment>

[Example of Configuration of Signal Processing Apparatus]

Figure 20:
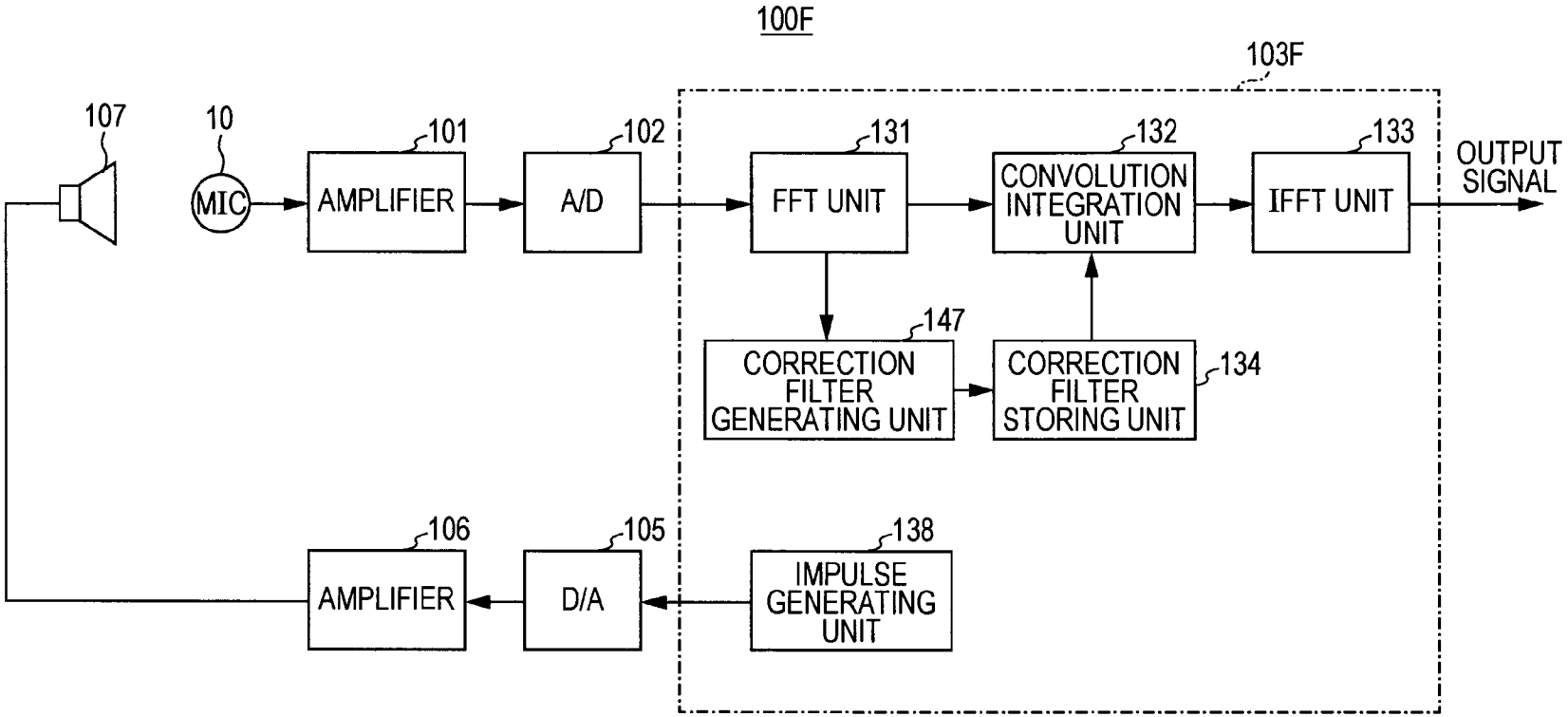
FIG. 20 is a block diagram illustrating an example of a configuration of a signal processing apparatus according to a seventh embodiment of the present disclosure.

FIG. 20 shows an example of a configuration of a signal processing apparatus 100F according to a seventh embodiment. In FIG. 20, the same reference numerals and signs are given to the parts corresponding to FIG. 1, and the description thereof is not repeated. The signal processing apparatus 100F includes an amplifier 101, an A/D converter 102, a signal processing unit 103F, a D/A converter 105, an amplifier 106, and a speaker 107. In the signal processing apparatus 100F, the correction filter (coefficient of correction filter) is generated by the signal processing unit 103F.

The signal processing unit 103F includes an FFT unit (fast Fourier transform unit) 131, a convolution integration unit 132, an inverse FFT unit 133, a correction filter storing unit 134, a correction filter generating unit 147, and an impulse generating unit 138. The correction filter generating unit 147 generates the correction filter (coefficient of correction filter) on the basis of frequency axis conversion data of the impulse response output from the FFT unit 131 at the time of generating the correction filter, and stores the correction filter in the correction filter storing unit 134. The impulse generating unit 138 outputs the impulse signal at the time of generating the correction filter. The D/A converter 105 converts the impulse signal output from the signal processing unit 103F from a digital signal into an analog signal. The amplifier 106 amplifies the output signal of the D/A converter 105, and supplies the signal to the speaker 107 constituting the output unit of the impulse signal.

An operation of the signal processing apparatus 100F shown in FIG. 20 will be described. The operation at the sound collection is the same as that of the signal processing apparatus 100 shown in FIG. 1, and is not described. Herein, an operation at the time of generating the correction filter will be described. The impulse signal output from the impulse signal generating unit 138 of the signal processing unit 103F is converted from a digital signal into an analog signal by the D/A converter 105, is amplified by the amplifier 106, and is supplied to the speaker 107. Accordingly, the impulse signal is output from the speaker 107.

As described above, the impulse signal output from the speaker 107 is measured by the microphone 10. The impulse response acquired by the microphone 10 is amplified by the amplifier 101, is converted from an analog signal into a digital signal by the A/D converter 102, and is supplied to the FFT unit 131 of the signal processing unit 103F. The frequency axis conversion data of the impulse response output from the FFT unit 131 is supplied to the correction filter generating unit 147. The correction filter (coefficient of correction filter) is generated on the basis of the frequency axis conversion data of the impulse response by the correction filter generating unit 147, and is stored in the correction filter storing unit 134.

In the signal processing apparatus 100F shown in FIG. 20, the characteristic of the correction filter of the correction filter storing unit 134 is the characteristic obtained by combining the reverse characteristic $Hm^{-1}$ of the output characteristic Hm of the microphone 10 and the reverse characteristic $Hc^{-1}$ of the sound characteristic Hc based on the environment and the structure surrounding the microphone 10. For this reason, in the signal processing apparatus 100F, it is possible to perform sound collection which is not easily affected by the environment and structure surrounding the microphone 10.

<8. Eighth Embodiment>

[Example of Configuration of Signal Process Device]

Figure 21:
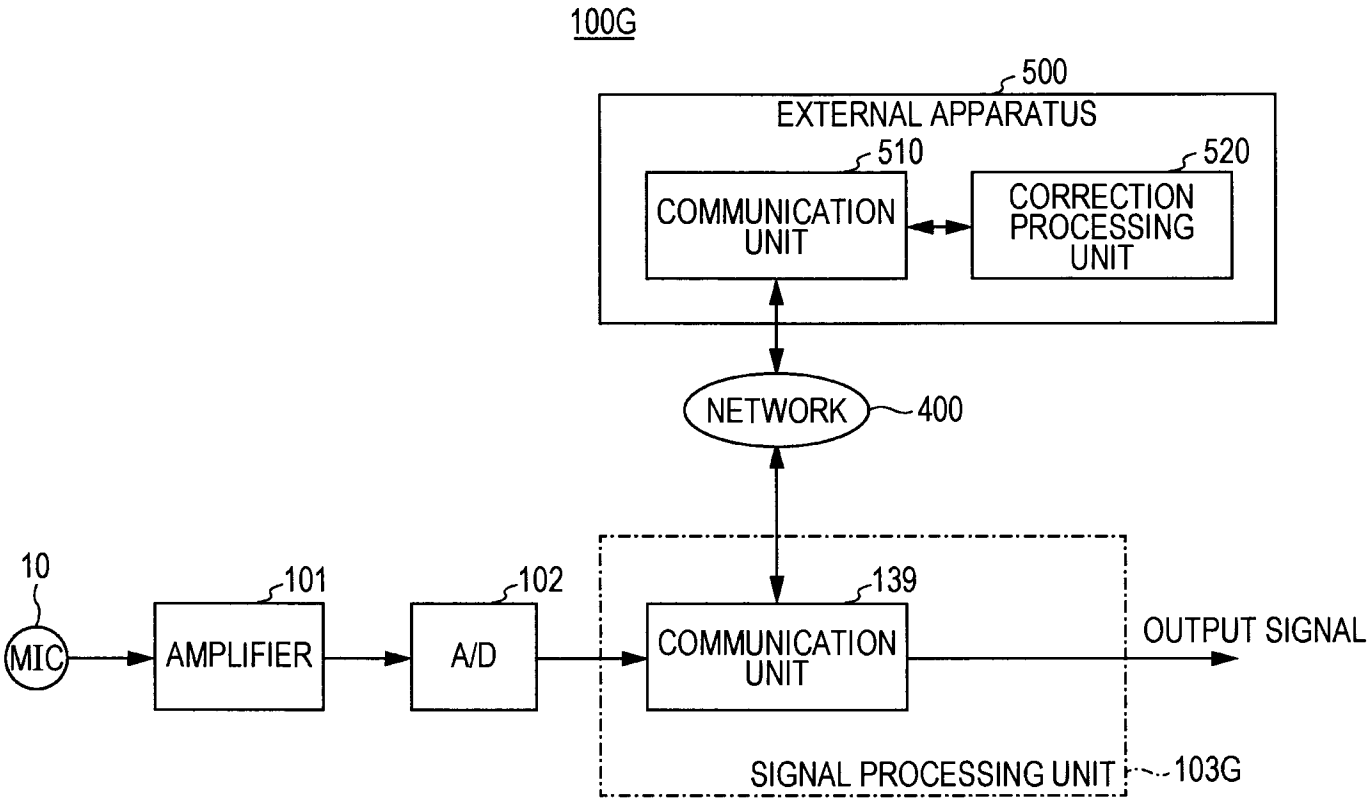
FIG. 21 is a block diagram illustrating an example of a configuration of a signal processing apparatus according to an eighth embodiment of the present disclosure.

FIG. 21 shows an example of a configuration of a signal processing apparatus 100G according to an eighth embodiment. In FIG. 20, the same reference numerals and signs are given to the parts corresponding to FIG. 1, and the description thereof is not repeated. The signal processing apparatus 100G includes an amplifier 101, an A/D converter 102, and a signal processing unit 103G. In the signal processing apparatus 100G, the signal processing unit 103G performs communication for filtering with an external device 500 connected to a network 400 such as the internet.

That is, the signal processing unit 103G has a communication unit 139. The communication unit 139 transmits the output signal of the A/D converter 102, that is, the signal acquired by the microphone 10 to the external device 500 through the network. The external device 500 has a communication unit 510 and a correction processing unit 520. Although the details are not described, the correction processing unit 520 is configured in the same manner as the signal processing unit 103 of the signal processing apparatus 100 shown in FIG. 1, and performs the same filtering process. The communication unit 139 receives a result of the filtering from the external device 500, and outputs the result as the output signal.

An operation of the signal processing apparatus 100G shown in FIG. 21 will be described. The signal acquired by the microphone 10 is amplified by the amplifier 101, is converted from an analog signal into a digital signal by the A/D converter 102, and then is supplied to the signal processing unit 103G. In the signal processing unit 103G, the output signal of the A/D converter 102, that is, the signal obtained by the microphone 10 is transmitted to the external device 500 through the network 400 by the communication unit 139.

In the external device 500, the filtering process is performed on the signal acquired by the microphone 10 by the correction processing unit 520. From the communication unit 139 to the external device 500, selection information of the correction filter to be used in the correction processing unit 520 is transmitted together with the signal acquired by the microphone 10. The selection information includes, for example, body information of the microphone 10 and target information.

In this case, the filtering of the characteristic obtained by combining the reverse characteristic $Hm^{-1}$ of the output characteristic Hm of the microphone 10 and a predetermined frequency characteristic Hs is performed by the correction processing unit 520, the body information of the microphone 10 and the reverse characteristic $Hm^{-1}$ are determined, and the frequency characteristic Hs is determined by the target information.

The result of the filtering with the predetermined correction filter characteristic by the correction processing unit 520 of the external device 500 is transmitted from the communication unit 510 of the external device 500 to the signal processing unit 103G through the network 400. The communication unit 139 of the signal processing unit 103G receives the result of the filtering, and outputs the result as the output signal.

Figure 22:
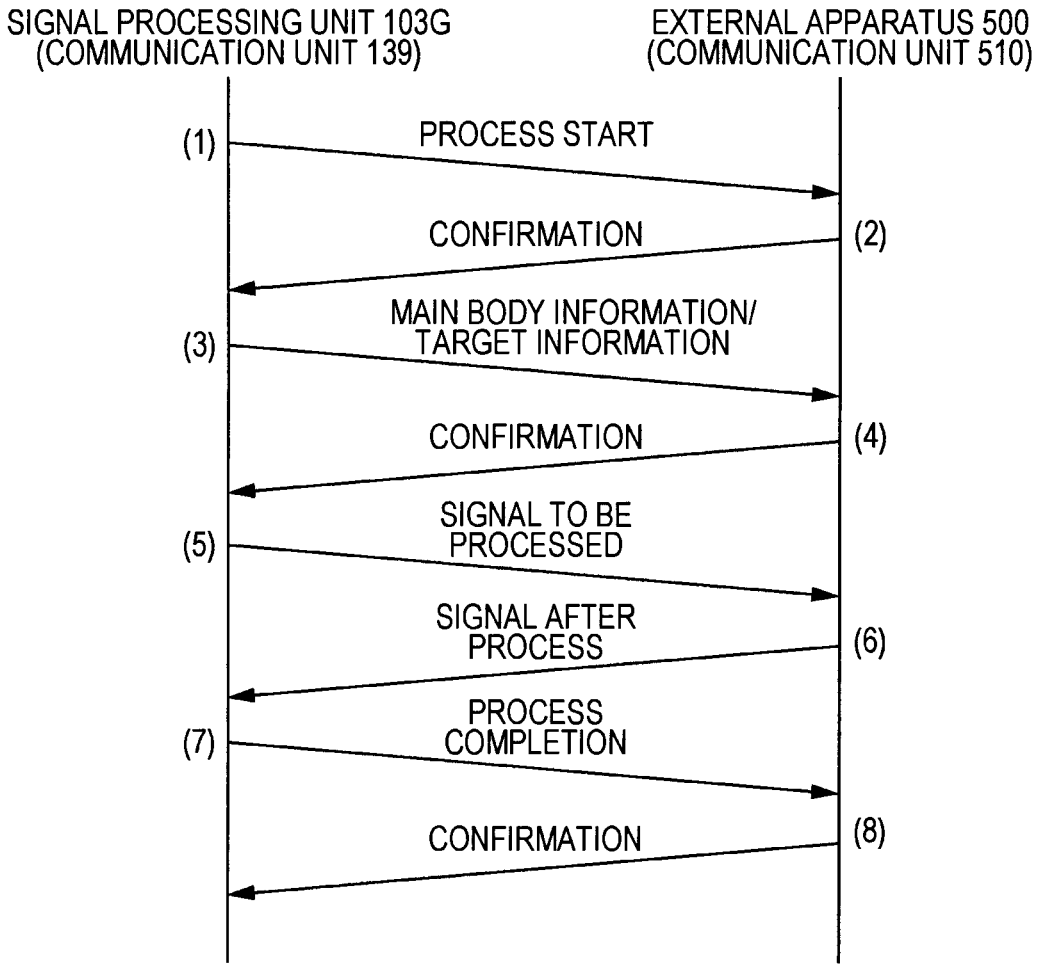
FIG. 22 is a sequence diagram illustrating an example of a communication procedure between a communication unit of a signal processing unit and a communication unit of an external device.

A sequence diagram shown in FIG. 22 shows an example of a communication procedure between the communication unit 139 of the signal processing unit 103G and the communication unit 510 of the external device 500. (1) The communication unit 139 transmits a process start command to the communication unit 510. (2) The communication unit 510 transmits an aacknowledgement to the communication unit 139 in response to the process start request. (3) Then, the communication unit 139 transmits the body information and the target information to the communication unit 510. (4) The communication unit 510 transmits an acknowledgement to the communication unit 139 in response to the information transmission.

(5) Then, the communication unit 139 transmits the signal to be processed, to the communication unit 510. (6) The communication unit 510 transmits the processed signal, that is, the filtering result to the communication unit 139. (7) Then, the communication unit 139 transmits a process end command to the communication unit 510. (8) The communication unit 510 transmits an acknowledgement to the communication unit 139.

In the signal processing apparatus 100G shown in FIG. 21, as described above, the filtering process is not performed by the signal processing unit 103G, but the filtering process is performed in the external device 500 connected through the network 400. For this reason, the signal processing unit 103G does not have, for example, a filter and a storage unit of a correction filter coefficient, the frequency characteristic is flattened, and it is possible to output the filtering result corrected to the sound characteristic in which the phase characteristic is a linear phase or the same sound characteristic as that of the other microphone.

In the signal processing apparatus 100G shown in FIG. 21, the signal acquired by the microphone 10 is transmitted to the external device 500, and the result of performing the filtering is received from the external device 500. However, basically, in a configuration of performing the filtering by the signal processing apparatus itself, it is conceivable that the body information and the target information are transmitted to the external device 500, and the correction filter (coefficient of correction filter) corresponding thereto is received from the external device 500.

<9. Modified Example>

The present disclosure may take the following configuration.

(1) A signal processing apparatus including a filter that performs filtering of a correction filter characteristic including a reverse characteristic of an output characteristic of a microphone on a signal acquired by the microphone.

(2) The signal processing apparatus according to (1), wherein the filter is a filter with a constant group delay characteristic.

(3) The signal processing apparatus according to (1) or (2), wherein the correction filter characteristic is the reverse characteristic of the output characteristic of the microphone.

(4) The signal processing apparatus according to (1) or (2), wherein the correction filter characteristic is a characteristic obtained by combining the reverse characteristic of the output characteristic of the microphone and a reverse characteristic of a sound characteristic based on a structure surrounding the microphone.

(5) The signal processing apparatus according to (1) or (2), wherein the correction filter characteristic is a characteristic obtained by combining the reverse characteristic of the output characteristic of the microphone and a predetermined sound characteristic.

(6) The signal processing apparatus according to (5), wherein the predetermined sound characteristic is a sound characteristic of the other microphone different from the microphone.

(7) The signal processing apparatus according to any one of (1) to (6), further comprising a signal switching unit that selectively outputs a signal acquired by the microphone or an output signal of the filter.

(8) The signal processing apparatus according to any one of (1) to (7), further including a filter characteristic switching unit that changes the correction filter characteristic of the filter, wherein a plurality of characteristics are provided as the correction filter characteristic of the filter.

The present disclosure contains subject matter related to that disclosed in Japanese Priority Patent Application JP 2011-077445 filed in the Japan Patent Office on Mar. 31, 2011, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A signal processing apparatus comprising:

circuitry configured to perform filtering of a correction filter characteristic including a reverse characteristic of an output characteristic of a microphone on a signal acquired by the microphone; and selectively output the signal acquired by the microphone or an output signal that has been filtered in accordance with the correction filter characteristic, wherein the correction filter characteristic is obtained by combining the reverse characteristic of the output characteristic of the microphone and a reverse characteristic of a sound characteristic based on at least one structure that diffracts or blocks a part of a sound wave from reaching a sound receiving face of the microphone, and wherein the acquired signal is acquired based on a part of the sound wave that is collected by the microphone.

2. The signal processing apparatus according to claim 1, wherein the correction filter characteristic has a constant group delay characteristic.

3. The signal processing apparatus according to claim 1, wherein the correction filter characteristic is the reverse characteristic of the output characteristic of the microphone.

4. The signal processing apparatus according to claim 1, wherein the correction filter characteristic is a characteristic obtained by combining the reverse characteristic of the output characteristic of the microphone and a predetermined sound characteristic.

5. The signal processing apparatus according to claim 4, wherein the predetermined sound characteristic is a sound characteristic of another microphone different from the microphone.

6. The signal processing apparatus according to claim 1, further comprising a filter characteristic switching unit that changes the correction filter characteristic, wherein a plurality of characteristics are provided as the correction filter characteristic.

7. The signal processing apparatus according to claim 1, wherein the filtering flattens a frequency characteristic of the microphone and makes linear a phase characteristic of the microphone.

8. A signal processing method being executed by a processor of a signal processing apparatus, the signal processing method comprising:

Performing, by the processor, filtering of a correction filter characteristic including a reverse characteristic of an output characteristic of a microphone on a signal acquired by the microphone; and selectively outputting the signal acquired by the microphone or an output signal that has been filtered in accordance with the correction filter characteristic, wherein the correction filter characteristic is obtained by combining the reverse characteristic of the output characteristic of the microphone and a reverse characteristic of a sound characteristic based on at least one structure that diffracts or blocks a part of a sound wave from reaching a sound receiving face of the microphone, and wherein the acquired signal is acquired based on a part of the sound wave that is collected by the microphone.

9. A non-transitory computer-readable medium having embodied thereon a program, which when executed by a processor causes the processor to perform a signal processing method, the signal processing method comprising:

initiating filtering of a correction filter characteristic including a reverse characteristic of an output characteristic of a microphone on a signal acquired by the microphone; and selectively outputting the signal acquired by the microphone or an output signal that has been filtered in accordance with the correction filter characteristic, wherein the correction filter characteristic is obtained by combining the reverse characteristic of the output characteristic of the microphone and a reverse characteristic of a sound characteristic based on at least one structure that diffracts or blocks a part of a sound wave from reaching a sound receiving face of the microphone, and wherein the acquired signal is acquired based on a part of the sound wave that is collected by the microphone.

10. A signal processing apparatus comprising;

circuitry configured to form a plurality of signal processing units that process signals acquired by a plurality of microphones, wherein at least one of the plurality of signal processing units has a filter that performs filtering of a correction filter characteristic including a reverse characteristic of an output characteristic of a corresponding microphone of the plurality of microphones on a signal acquired by the corresponding microphone, and selectively output the signal acquired by the corresponding microphone or an output signal that has been filtered in accordance with the correction filter characteristic, wherein the correction filter characteristic is obtained by combining the reverse characteristic of the output characteristic of the corresponding microphone and a reverse characteristic of a sound characteristic based on at least one structure that diffracts or blocks a part of a sound wave from reaching a sound receiving face of the corresponding microphone, and wherein the acquired signals are acquired based on a part of the sound wave that is collected by the plurality of microphones.

11. The signal processing apparatus according to claim 10, wherein the filter is a filter having a constant group delay characteristic.

12. The signal processing apparatus according to claim 10, wherein the correction filter characteristic is a characteristic obtained by combining the reverse characteristic of the output characteristic of the corresponding microphone and a predetermined sound characteristic.

13. The signal processing apparatus according to claim 12, wherein the predetermined sound characteristic is a sound characteristic of the other microphone different from the corresponding microphone.

* * * * *